US007017831B2

(12) United States Patent
Santiago et al.

(10) Patent No.: US 7,017,831 B2
(45) Date of Patent: Mar. 28, 2006

(54) SPRINKLER SYSTEM

(75) Inventors: Miguel Santiago, Claremont, CA (US); Jeff McKenzie, Blue Jay, CA (US); Peter Janku, Temecula, CA (US); Steven C. Renquist, Chino Hills, CA (US); Hyok Lee, Corona, CA (US); Steve K. Kish, Rancho Cucamonga, CA (US); James T. Wright, III, Moreno Valley, CA (US); Chad McCormick, West Covina, CA (US)

(73) Assignee: The Toro Company, Bloomington, MN (US)

( * ) Notice: Subject to any disclaimer, the term of this patent is extended or adjusted under 35 U.S.C. 154(b) by 58 days.

(21) Appl. No.: 10/774,705

(22) Filed: Feb. 9, 2004

(65) Prior Publication Data

US 2004/0195358 A1 Oct. 7, 2004

Related U.S. Application Data

(60) Provisional application No. 60/445,865, filed on Feb. 8, 2002.

(51) Int. Cl.
*B05B 3/02* (2006.01)

(52) U.S. Cl. ..... 239/222.13; 239/232; 239/200; 239/206

(58) Field of Classification Search ..... 239/200, 239/206, 222.13, 232, DIG. 1
See application file for complete search history.

(56) References Cited

U.S. PATENT DOCUMENTS

| | | | | | |
|---|---|---|---|---|---|
| 3,107,056 | A | * | 10/1963 | Hunter | 239/206 |
| 4,540,125 | A | * | 9/1985 | Gorney et al. | 239/232 |
| 5,383,600 | A | * | 1/1995 | Verbera et al. | 239/206 |
| 5,845,849 | A | | 12/1998 | Mitzlaff | |
| 6,029,907 | A | | 2/2000 | McKenzie | |
| 6,050,502 | A | * | 4/2000 | Clark | 239/206 |

* cited by examiner

*Primary Examiner*—David A. Scherbel
*Assistant Examiner*—Seth Barney
(74) *Attorney, Agent, or Firm*—Inskeep IP Group, Inc.

(57) ABSTRACT

A rotary sprinkler having a rotatable nozzle assembly for watering an arc of ground traversed or swept by the nozzle assembly as the nozzle assembly rotates is disclosed. Oscillating rotation is achieved via a drive train that includes a trip spring that is drivable between first and second positions for reversing the direction of nozzle rotation. The sprinkler also includes: a variable trajectory nozzle; secondary opening adjacent the variable trajectory nozzle; an automatic break up screw configuration; a substantially constant speed turbine assembly; a bypass stator; a reversing cluster gear planetary drive with a uni-directional turbine; an overcenter reversing mechanism; a nozzle base clutch; an adjustable arc mechanism, solid arc limit stops, a snap ring installation method and an adjustable pilot valve which uses visual indicia.

32 Claims, 34 Drawing Sheets

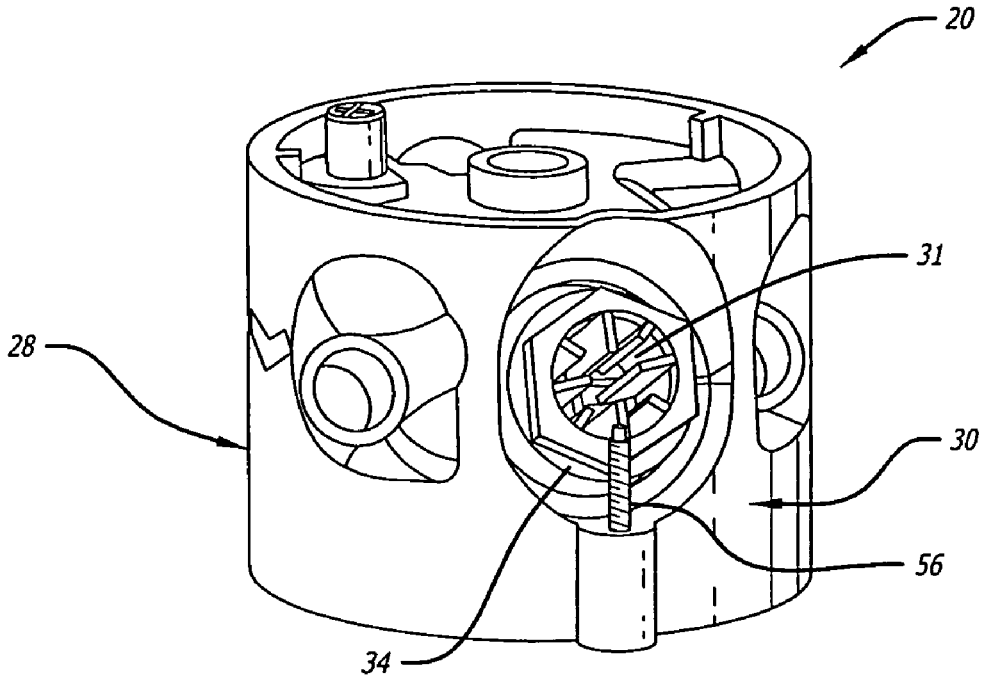
FIG. 4B
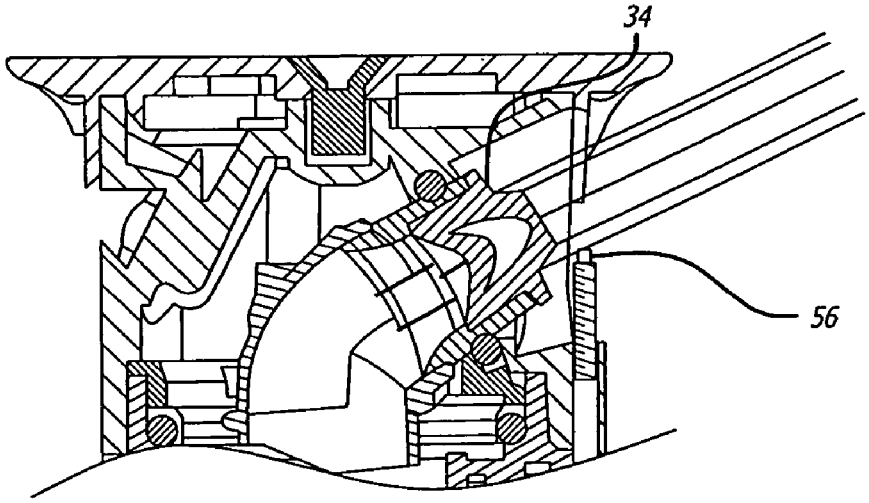
FIG. 4C
FIG. 5
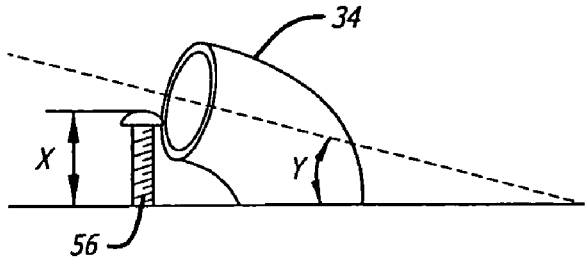

FIG. 15B
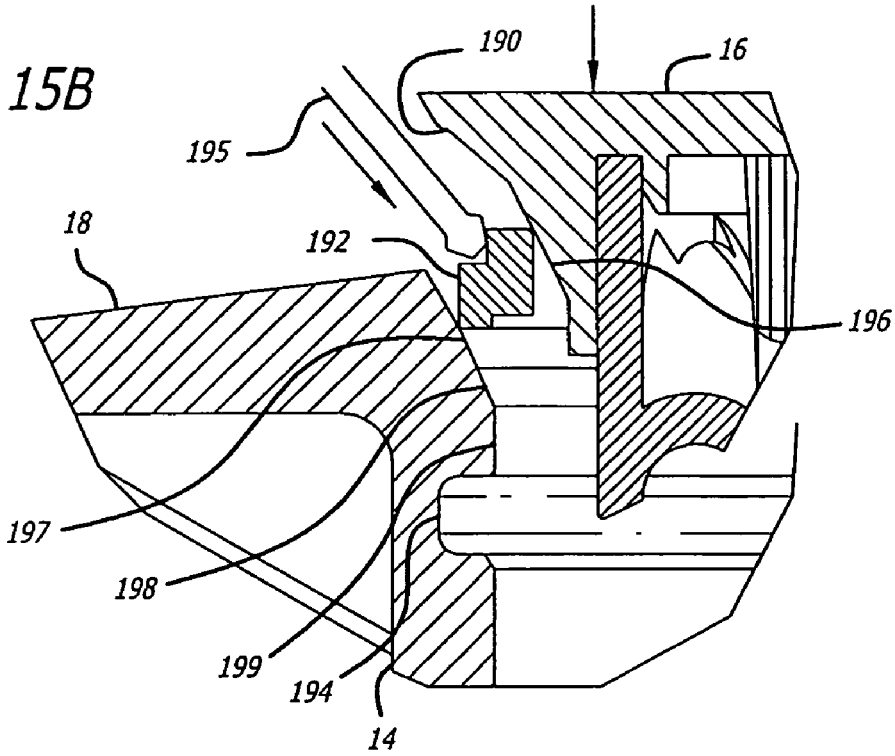
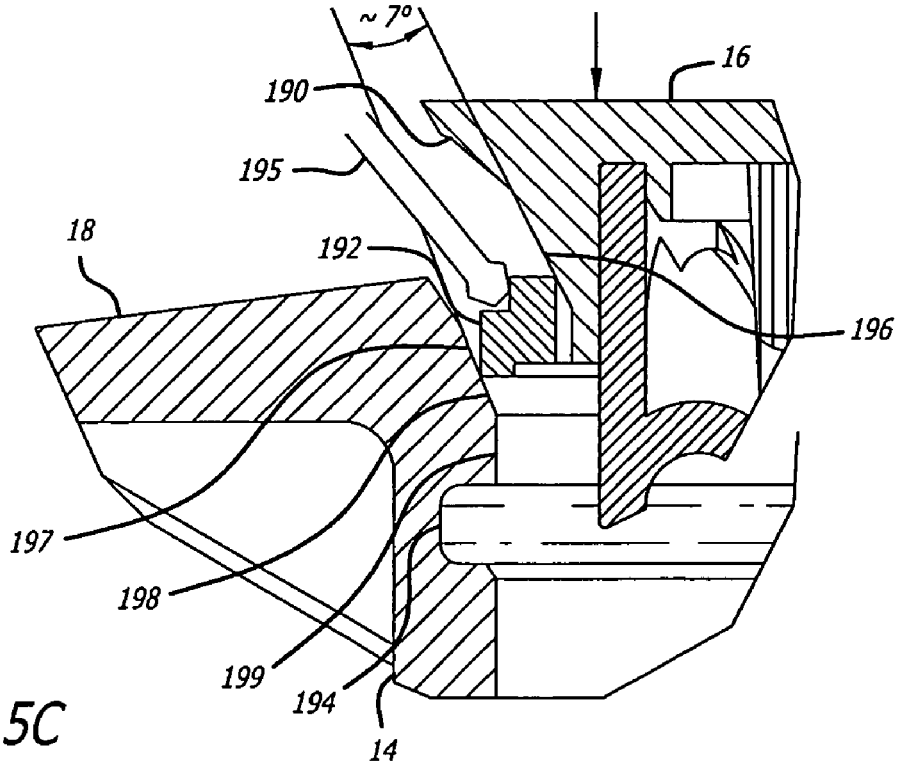
FIG. 15C

FIG. 15D
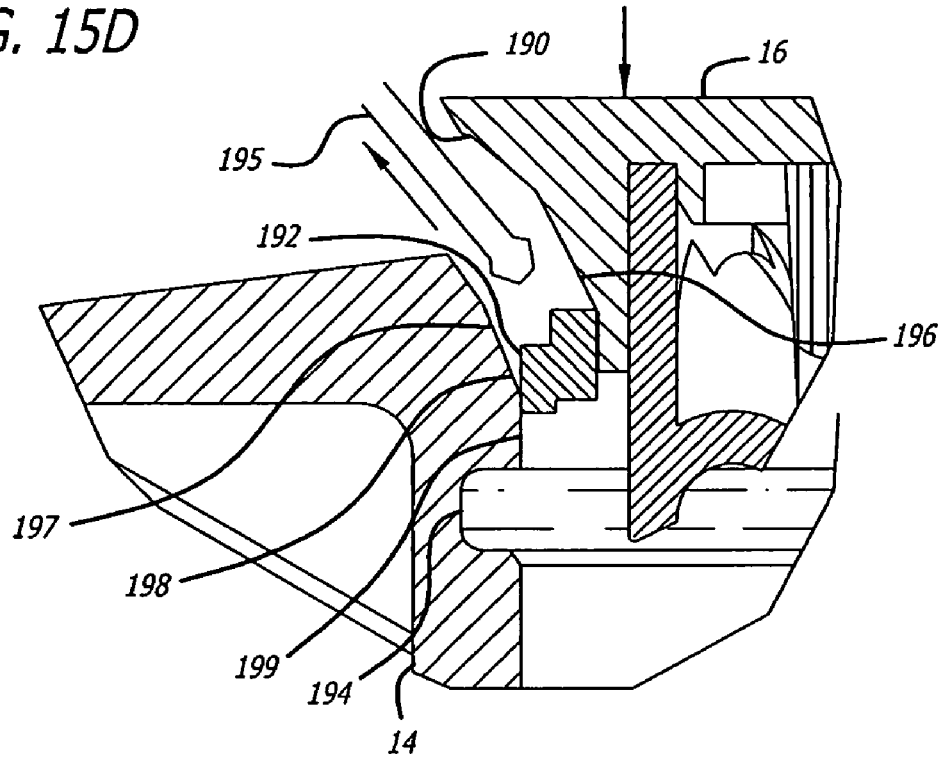
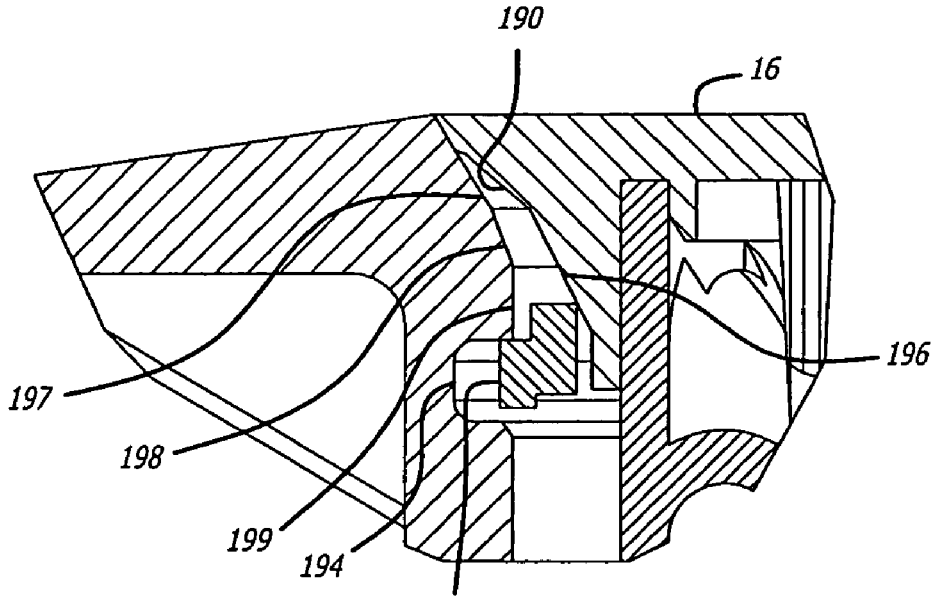
FIG. 15E

FIG. 15F
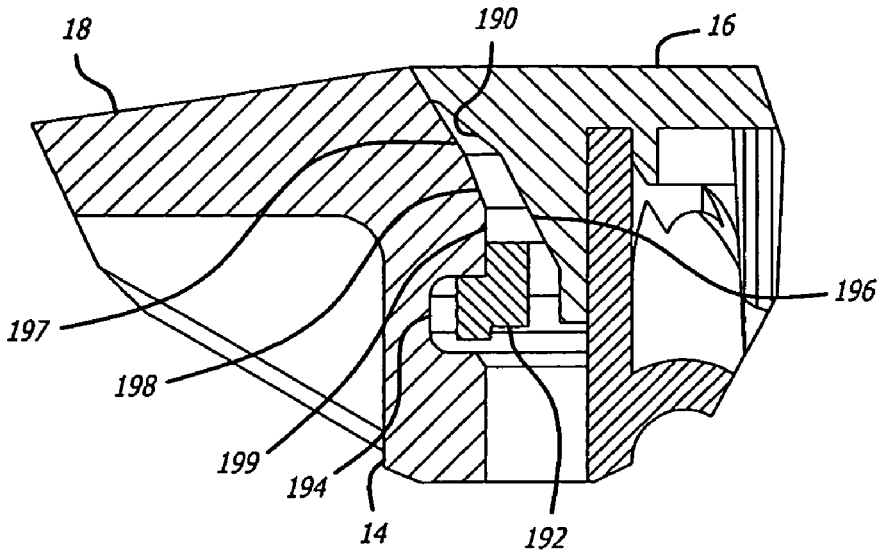
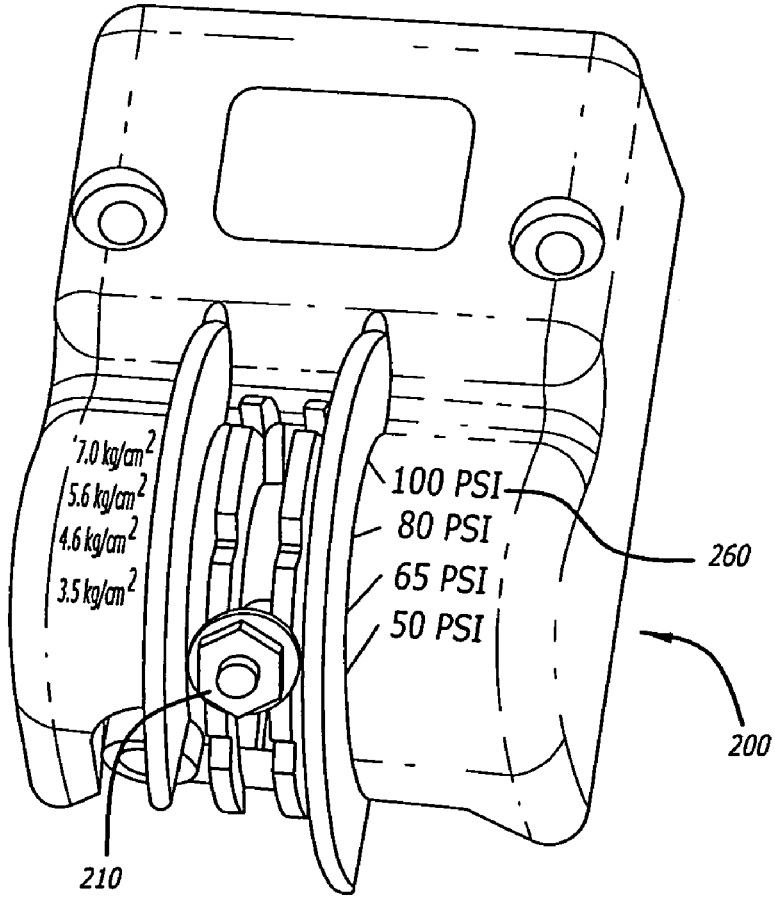
FIG. 16A

FIG. 18A
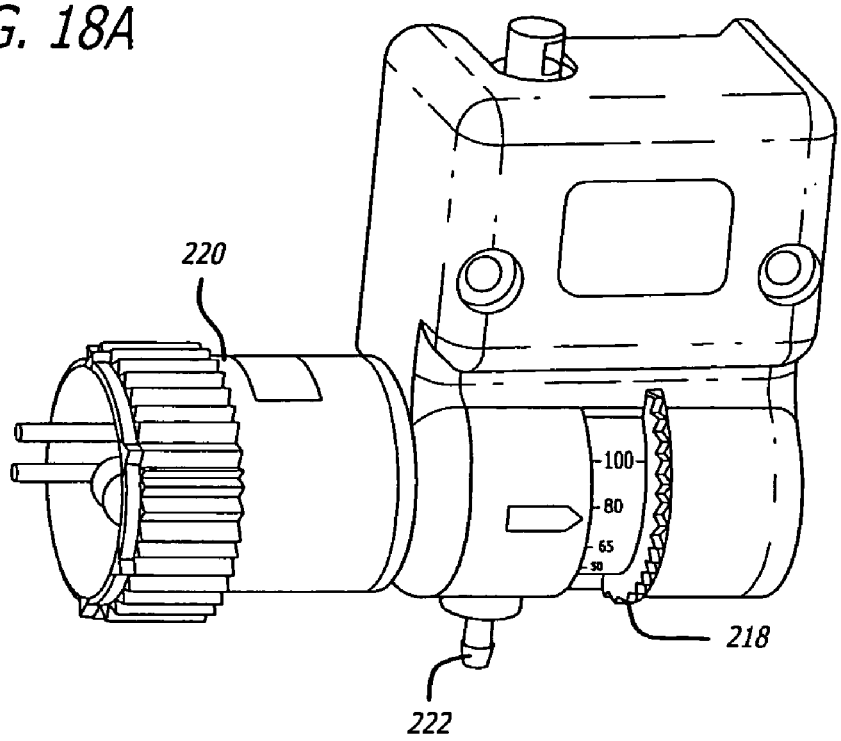
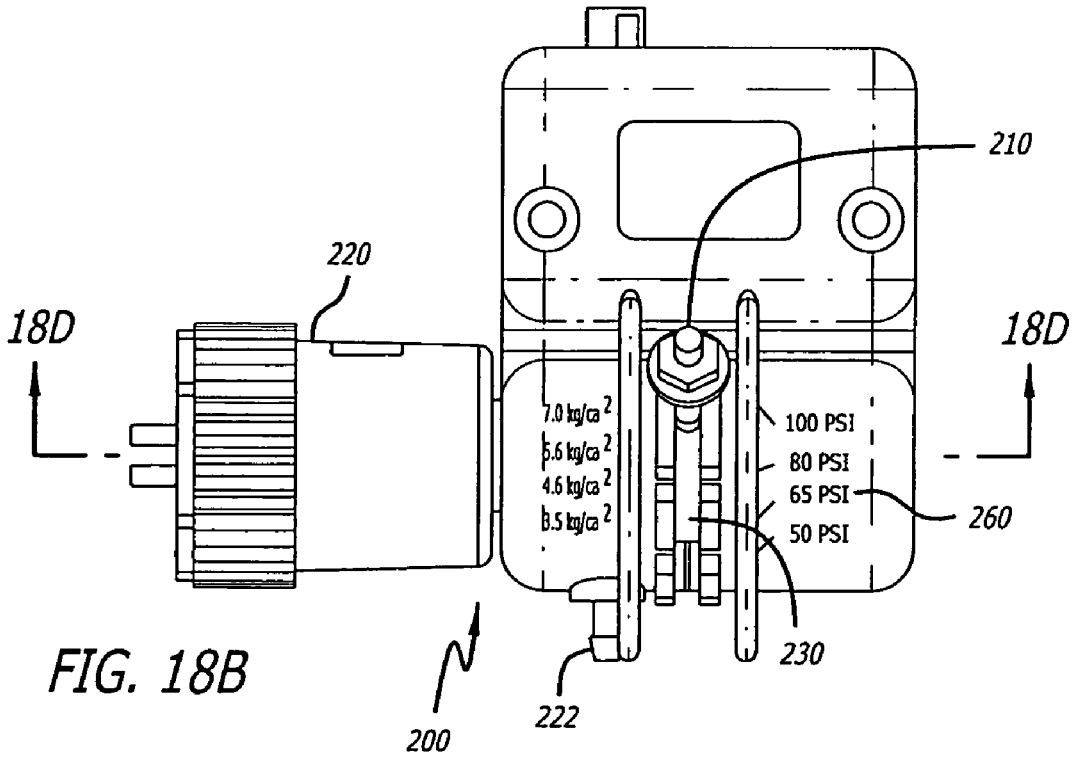
FIG. 18B

SPRINKLER SYSTEM

CROSS REFERENCE TO RELATED APPLICATIONS

This application claims the benefit of U.S. Provisional Application No. 60/445,865, entitled Sprinkler System, filed Feb. 8, 2002, the entire contents of which are hereby incorporated by reference.

BACKGROUND OF THE INVENTION

Sprinkler systems for turf irrigation are well known. Typical systems include a plurality of valves and sprinkler heads in fluid communication with a water source, and a centralized controller connected to the water valves. At appropriate times the controller opens the normally closed valves to allow water to flow from the water source to the sprinkler heads. Water then issues from the sprinkler heads in predetermined fashion.

There are many different types of sprinkler heads, including above-the-ground heads and "pop-up" heads. Pop-up sprinklers, though generally more complicated and expensive than other types of sprinklers, are thought to be superior. There are several reasons for this. For example, a pop-up sprinkler's nozzle opening is typically covered when the sprinkler is not in use and is therefore less likely to be partially or completely plugged by debris or insects. Also, when not being used, a pop-up sprinkler is entirely below the surface and out of the way.

The typical pop-up sprinkler head includes a stationary body and a "riser" which extends vertically upward, or "pops up," when water is allowed to flow to the sprinkler. The riser is in the nature of a hollow tube which supports a nozzle at its upper end. When the normally-closed valve associated with a sprinkler opens to allow water to flow to the sprinkler, two things happen: (i) water pressure pushes against the riser to move it from its retracted to its fully extended position, and (ii) water flows axially upward through the riser, and the nozzle receives the axial flow from the riser and turns it radially to create a radial stream. A spring or other type of resilient element is interposed between the body and the riser to continuously urge the riser toward its retracted, subsurface, position, so that when water pressure is removed the riser will immediately proceed from its extended to its retracted position.

The riser of a pop-up or above-the-ground sprinkler head can remain rotationally stationary or can include a portion that rotates in continuous or oscillatory fashion to water a circular or partly circular area, respectively. More specifically, the riser of the typical rotary sprinkler includes a first portion, which does not rotate, and a second portion, which rotates relative to the first (non-rotating) portion.

The rotating portion of a rotary sprinkler riser typically carries a nozzle at its uppermost end. The nozzle throws at least one water stream outwardly to one side of the nozzle assembly. As the nozzle assembly rotates, the water stream travels or sweeps over the ground.

The non-rotating portion of a rotary sprinkler riser typically includes a drive mechanism for rotating the nozzle. The drive mechanism generally includes a turbine and a transmission. The turbine is usually made with a series of angular vanes on a central rotating shaft that is actuated by a flow of fluid subject to pressure. The transmission consists of a reduction gear train that converts rotation of the turbine to rotation of the nozzle assembly at a speed slower than the speed of rotation of the turbine.

During use, as the initial inrush and pressurization of water enters the riser, it strikes against the vanes of the turbine causing rotation of the turbine and, in particular, the turbine shaft. Rotation of the turbine shaft, which extends into the drive housing, drives the reduction gear train that causes rotation of an output shaft located at the other end of the drive housing. Because the output shaft is attached to the nozzle assembly, the nozzle assembly is thereby rotated, but at a reduced speed that is determined by the amount of the reduction provided by the reduction gear train.

With such sprinkler systems, a wide variation in fluid flow out of the nozzle can be obtained. If the system is subject to an increase in fluid flow rate through the riser, the speed of nozzle rotation increases proportionally due to the increased water velocity directed at the vanes of the turbine. In general, increases or decreases in nozzle speed can adversely affect the desired water distribution.

In addition to nozzle rotation and fluid flow variations, conventional rotary sprinkler systems often produce uneven water distributions. The rotating portion of a rotary sprinkler riser typically carries a nozzle at its uppermost end. The nozzle throws at least one water stream outwardly to one side of the nozzle assembly. As the nozzle assembly rotates, the water stream travels or sweeps over the ground, water is thrown in a coherent stream at some trajectory relative to the surface to be watered, the stream will tend to water a doughnut shaped ring around the sprinkler with little water being deposited close to the sprinkler. This is obviously a disadvantage since the vegetation close to the sprinkler will be under-watered.

Prior art rotary sprinkler systems are typically provided with some type of arc adjusting mechanism, often comprising two arc limit stops that are relatively adjustable to one another. Such stops are typically carried adjacent to one another with the stops being continuously coupled to a part of the drive reversing mechanism. In adjusting one stop relative to another, the adjustable stop(s) are often necessarily ratcheted over serrations or detents, thus making adjustment somewhat difficult or unnatural.

Rotary sprinklers having rotary drives often include some type of clutch that allows the rotary nozzle assembly to be forced past the drive without damaging the drive. Some such clutches comprise detent or serration type clutches as well as simple friction clutches. It would be desirable to have a clutch that acts like a friction clutch in terms of smoothness of operation but operates with minimal drag or torque. In view of the above, there is a need for an improved rotary sprinkler system for both above-the ground and pop-up rotary sprinkler systems. In particular, it is desirable that the rotary sprinkler system provides a consistent and predictable watering pattern and volume. In addition, the rotary sprinkler system should also be configured to prevent excessive wear on the rotating parts of the system. Furthermore, it is desirable that the rotary sprinkler system controls the rate of rotation of the nozzle. More particularly, it is desirable that the rotary sprinkler system keeps the rate of nozzle rotation relatively constant.

BRIEF SUMMARY OF THE INVENTION

In view of the foregoing, it is an object of the present invention to provide an improved rotary sprinkler system that addresses the aforementioned and other undesirable aspects of prior art rotary sprinkler systems.

It is a further object of the present invention to provide a rotary sprinkler system having a consistent and predictable watering pattern and volume.

BRIEF DESCRIPTION OF THE DRAWINGS

Other features and advantages of the present invention will be seen as the following description of particular embodiments progresses in conjunction with the drawings, in which:

FIG. 4B illustrates a perspective view of the embodiment of a nozzle assembly of FIG. 4A;

FIG. 4C illustrates a cross-sectional view of another embodiment of a nozzle assembly in accordance with the present invention;

FIG. 5 illustrates an embodiment of a water trajectory angle in relation to water breakup screw height in accordance with the present invention;

FIGS. 14 and 15A–15F illustrate an embodiment of a snap ring installation in accordance with the present invention; and FIGS. 16A–16C illustrate an embodiment of an adjustable pilot valve in accordance with the present invention;

FIGS. 18A–18E illustrate another embodiment of an adjustable pilot valve in accordance with the present invention;

DETAILED DESCRIPTION OF THE INVENTION

Figure 1B:
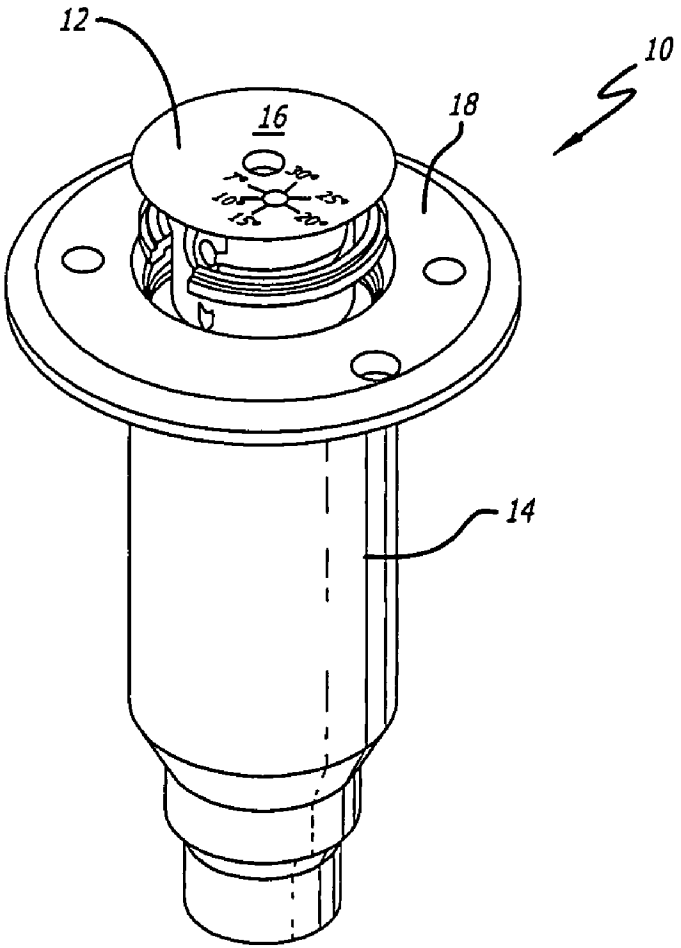
FIG. 1B illustrates an alternate view of an embodiment of a sprinkler system in accordance with the present invention.
Figure 1A:
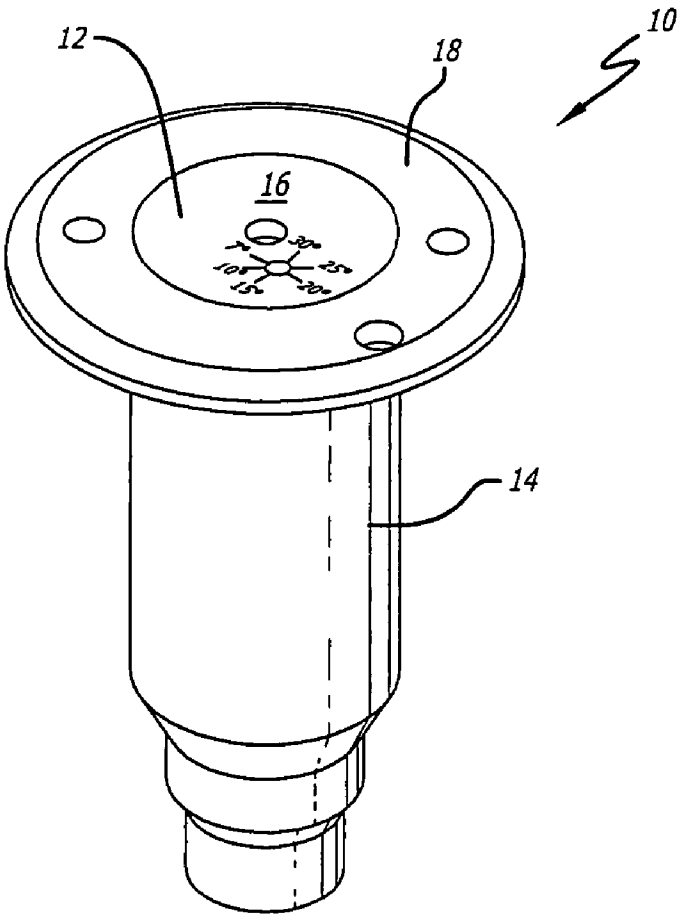
FIG. 1A is a perspective view of an embodiment of a sprinkler system in accordance with the present invention.
Figure 1C:
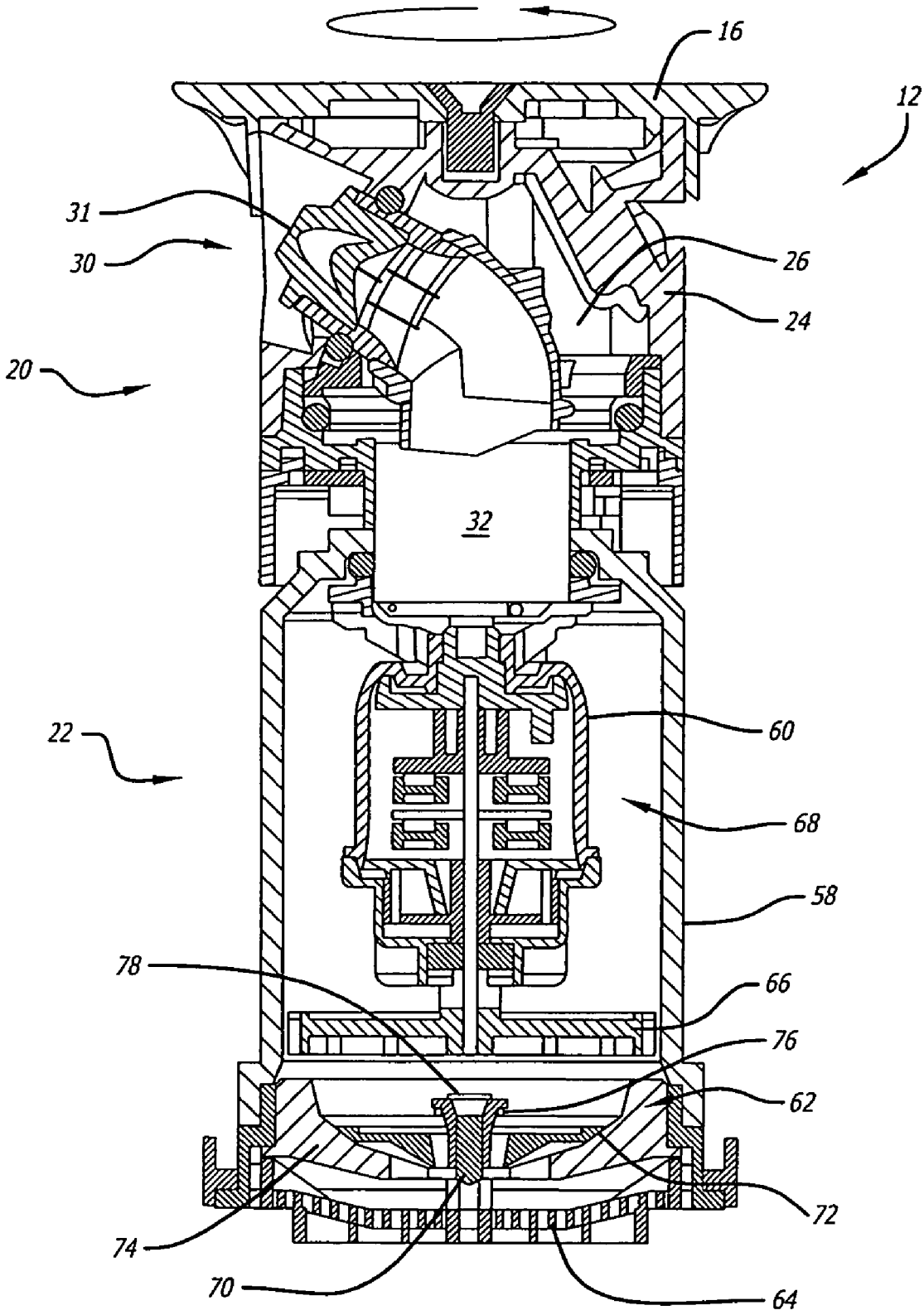
FIG. 1C illustrates a sectional view of an embodiment of a sprinkler system in accordance with the present invention.

Referring to FIGS. 1A, 1B and 1C, a rotary sprinkler assembly 10 in accordance with one embodiment of the present invention includes a pop-up riser assembly 12 reciprocally carried within an outer sprinkler body 14. When water pressure is not present within the interior of the sprinkler body 14, the riser assembly 12 is retracted by a retraction spring (not shown) housed within the sprinkler body 14. The retraction spring maintains the riser assembly 12 within the sprinkler body 14 so that the top cap 16 of the riser 12 is generally flush with a top flange 18 on the sprinkler body 14. However, when water is present within the sprinkler body 14 and is of sufficient pressure to counteract the retraction spring forces, the riser assembly 12 "pops-up" or extends out of the sprinkler body 14, thereby allowing water to issue from the sprinkler system 10 in a predetermined fashion. Although the following description is made with reference to pop-up type sprinklers, the invention is not limited thereto and can be used with any conventional rotating type sprinkler head.

As shown in FIG. 1C, the riser assembly 12 generally includes two major components. The first component is a rotatable nozzle base assembly 20. The second component, located beneath the nozzle base assembly 20, is the non-rotatable riser body assembly 22. During operation of the sprinkler assembly 10, the nozzle base assembly 20 rotates around the axis of the sprinkler assembly 10 relative to the riser body assembly 22, as illustrated by the arrows and described in further detail below.

Nozzle Base Assembly 20

Referring to FIG. 1C, the nozzle base assembly 20 includes a cylindrically-shaped nozzle base housing 24 having an interior portion 26 and a top cap or wall 16 fixedly secured thereto. An outwardly extending cavity or seat 30 is formed within a portion of the nozzle base housing 24. The cavity 30 is configured to receive a nozzle body that, for example, throws a stream of water to one side of the nozzle base assembly 20. Located within the interior portion 26 of the nozzle base assembly 20 is a downwardly extending water supply tube 32. The water supply tube 32 conducts water passing up through the riser body assembly 22, into the interior of the nozzle housing 24 and out through the nozzle in a stream like form.

As noted in the Background of the Invention as set forth above, a nozzle base assembly 20 having one nozzle 31 that throws a water stream outwardly to one side of the nozzle base assembly 20 may produce uneven or non-uniform irrigation patterns. For example, as the nozzle base assembly 20 rotates, the water stream travels or sweeps over the ground. If water is thrown in a coherent stream at some trajectory relative to the surface to be watered, the stream will tend to water a doughnut shaped ring around the sprinkler with little water being deposited close to the sprinkler. This is obviously a disadvantage since vegetation close to the sprinkler will be under-watered and vegetation along the ring-shaped path will be over-watered. As the present invention substantially eliminates these undesirable characteristics, it is instructive to describe the sprinkler system features that produce a desired irrigation scheme. For this purpose, reference is made to FIG. 2, which illustrates an embodiment of the nozzle base assembly 20 of the present invention.

Variable Trajectory Nozzle

Figure 2:
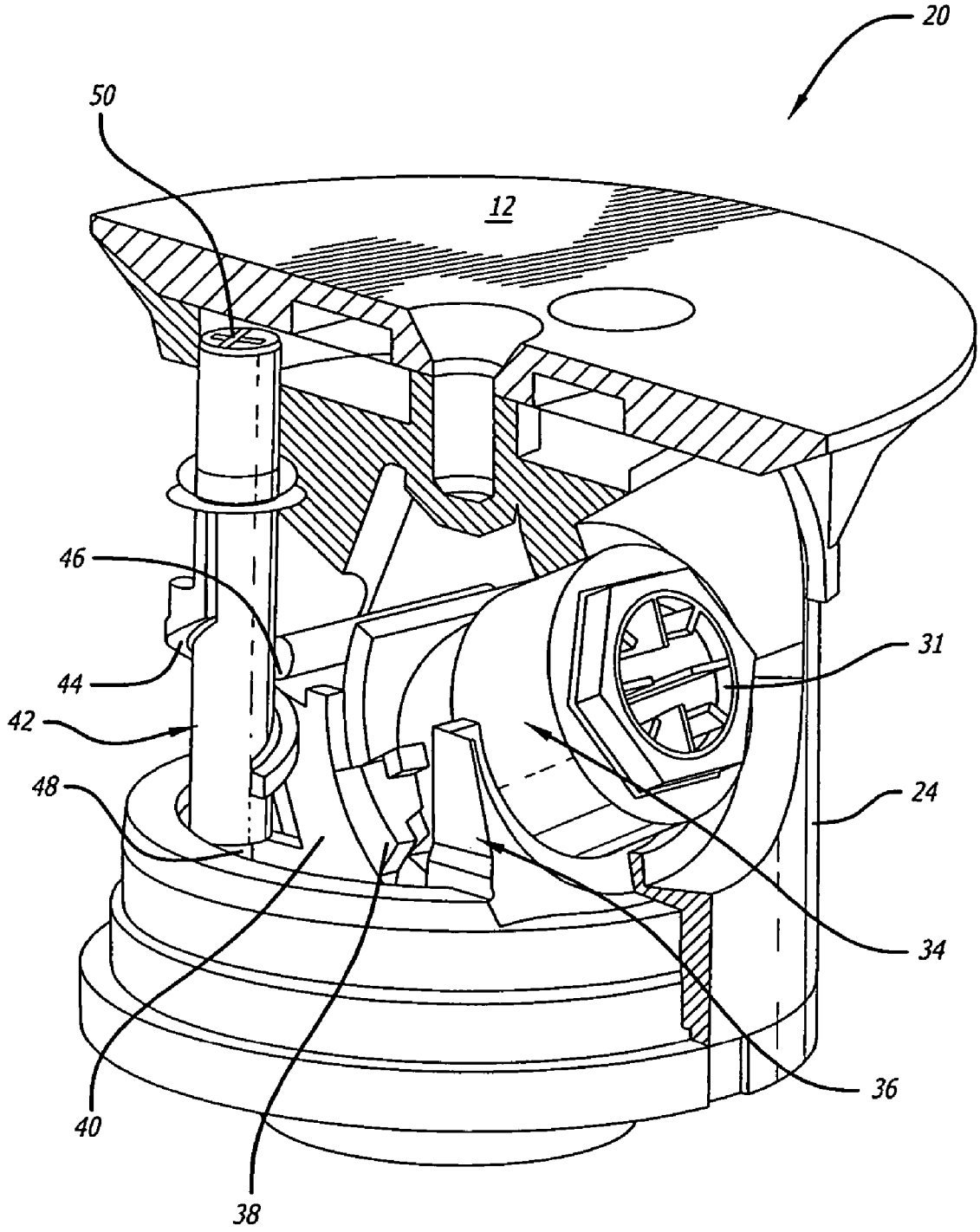
FIG. 2 illustrates one embodiment of a nozzle assembly in accordance with the present invention.
Figure 3A:
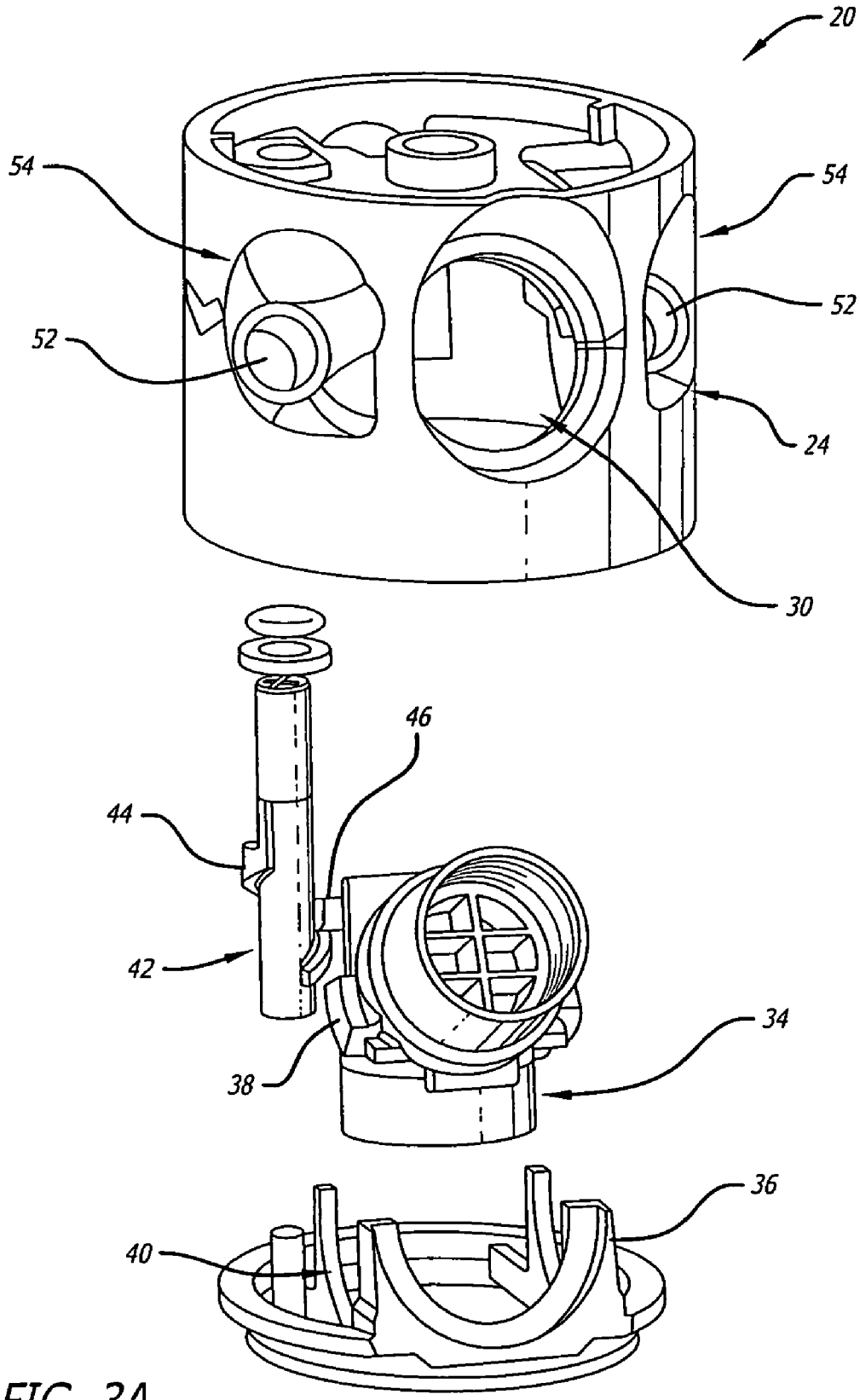
FIGS. 3A–3C illustrate various views of an embodiment of a nozzle assembly in accordance with the present invention.
Figure 3B:
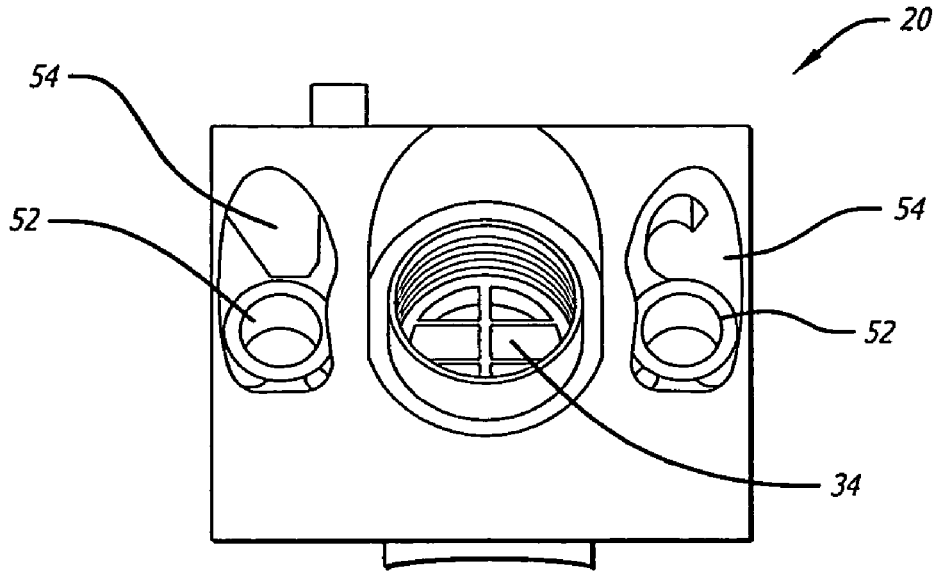
Figure 3C:
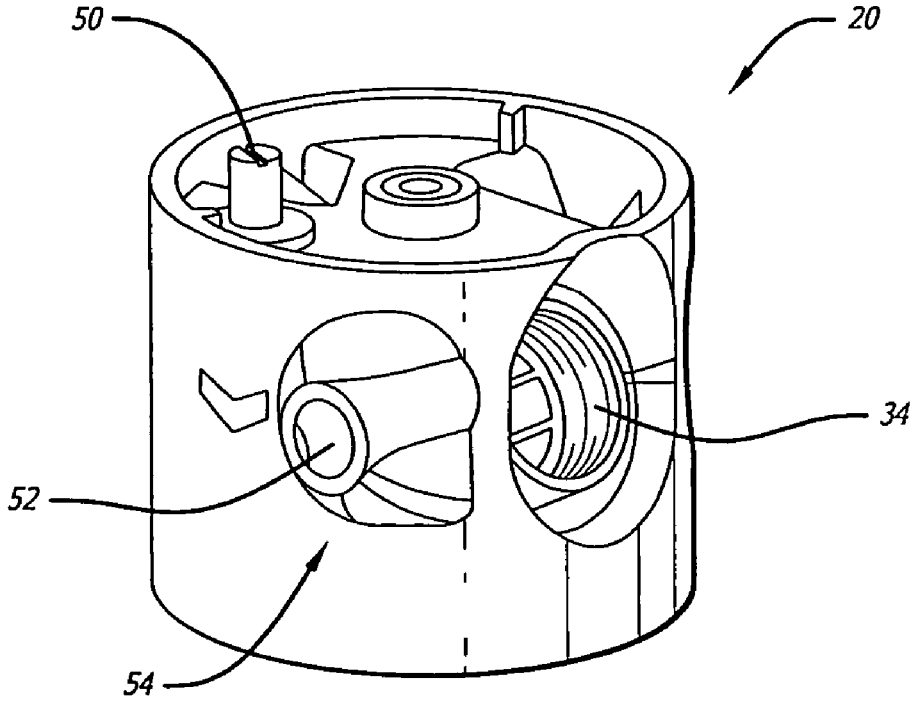

As shown in FIGS. 2–3C, the variable trajectory nozzle body 34 is pivotally mounted or seats within a nozzle support structure 36 located within the nozzle base assembly 20. Curved tabs 38 extending on each side of the nozzle body 34 are captured by curved slots 40 within the nozzle base assembly 20 to form a pivotal connection. When the nozzle support structure 36 is assembled together with the nozzle base housing 24, two upper curved surfaces (not shown) of the nozzle base housing 24 overlie and are spaced from two lower curved surfaces of the nozzle support 36 to form the curved slots 40 in which the tabs 38 are captured. As such, the nozzle body 34 is not only secured but also pivotally received within the nozzle base housing 24 for pivoting motion about a substantially horizontal pivot axis to adjust the trajectory of the water stream exiting the nozzle body 34.

This preferred embodiment of the present invention may also be seen in commonly assigned and copending U.S. patent application Ser. No. 10/455,868, filed Jun. 5, 2002 entitled Rotary Sprinkler With Arc Adjustment Guide And Flow Through Shaft, the contents of which are hereby incorporated by reference.

The trajectory of the nozzle body 34 is adjusted via the trajectory adjuster 42. The trajectory adjuster 42 is a generally rod-shaped member with a threaded section 44 configured to engage a slot 46 on the variable trajectory nozzle 34. As shown in FIG. 2, the trajectory adjuster 42 is vertically and rotatably oriented at its lower end on a pivot pin 48 within the nozzle base housing 20. The upper end of the trajectory adjuster 42 extends through to the top 12 of the nozzle base housing 20 and includes an opening 50 shaped to receive a screwdriver or similar tool.

When the trajectory adjuster 42 is rotated, the engagement of its threaded section 44 with the slot 46 on the nozzle body 34 causes the nozzle body 34 to pivot about its horizontal axis with its curved tabs 38 riding or sliding up or down on the mating curved surfaces of the nozzle support structure 36. This, in turn, either raises or lowers the water-discharge end of the nozzle body 34 and, thereby, adjusts the trajectory of the nozzle body 34. For example, rotating the trajectory adjuster 42 in one direction (e.g. counter clockwise) pivots the outer, water-emitting end of the nozzle body 34 upwardly to raise the trajectory of the water stream thrown by the nozzle body 34. Likewise, rotating the trajectory adjuster 42 in the opposite direction (e.g. clockwise) pivots the outer end of the nozzle body 34 downwardly to lower the trajectory of the water stream thrown by the nozzle body 34.

The purpose of the variable trajectory nozzle body 34 is to keep a continuous flow path to the nozzle opening 31 as the trajectory of the variable trajectory nozzle body 34 is changed. This allows the water flowing from water supply tube 32 to the nozzle opening 31 to be maximized in velocity and minimized in turbulence. The curvature of the variable trajectory nozzle body 34 is designed to prevent turbulence independent of the trajectory. The bottom opening brings water into the variable trajectory nozzle body 34 from the water supply tube 32 and allows a path that keeps the pressure inside the tube substantially constant from the bottom of the nozzle opening 31, perpendicular to the set trajectory, to the top as it enters the nozzle opening 31 parallel to the set trajectory. This pressure stabilization helps to keep a velocity profile that is parallel to the set trajectory and is desirable for good performance. Without the curved tube a pressure drop occurs from the bottom to the top of the entrance to the nozzle opening 31 which causes turbulence and inconsistent velocity profiles across the range of trajectory angles. The curvature keeps the velocity profiles consistent across the range of trajectories. This in turn helps to maximize radius of the nozzle 31.

Secondary Nozzles

Figure 4A:
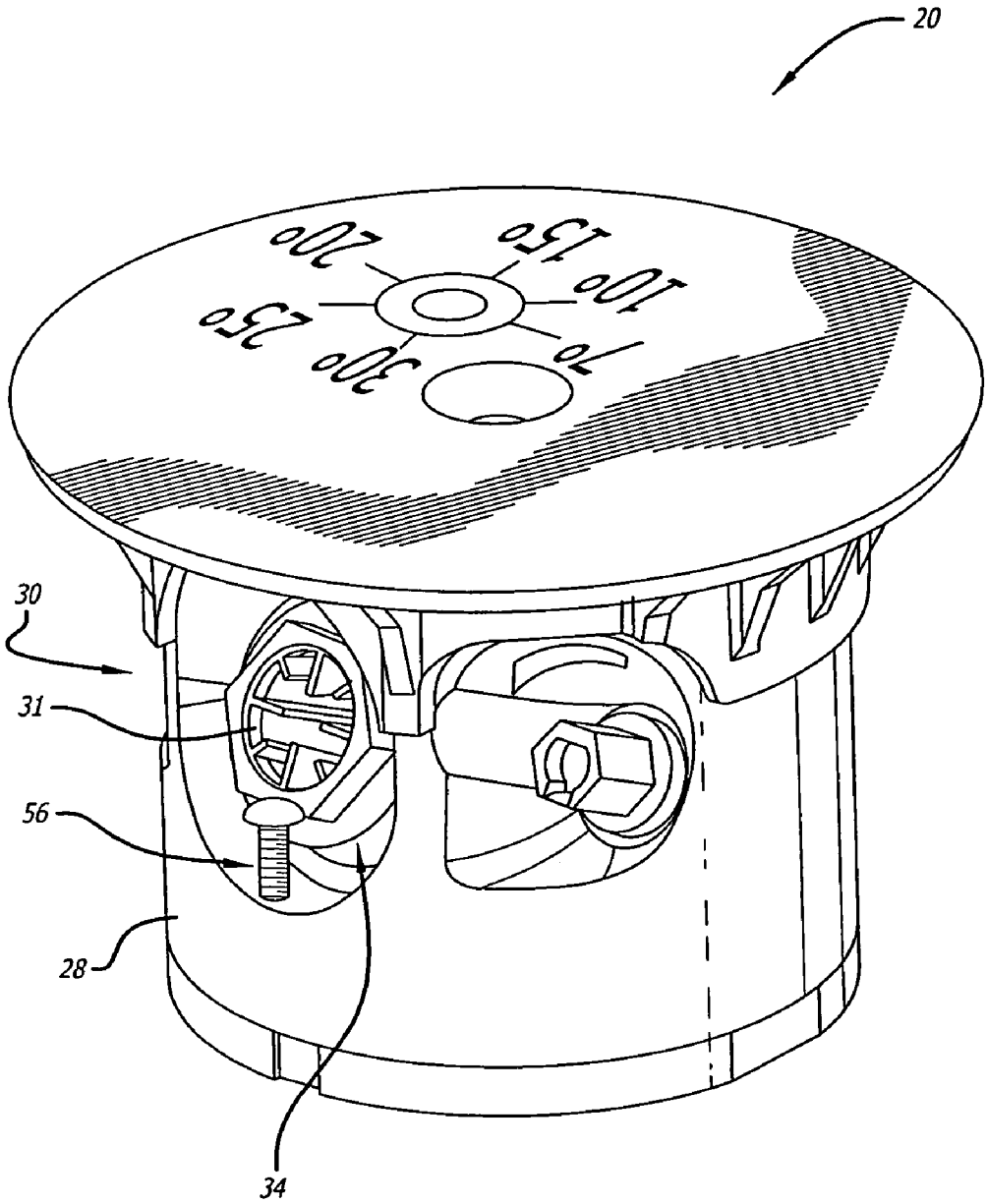
FIG. 4A illustrates a perspective view of another embodiment of a nozzle assembly in accordance with the present invention.

In addition to the variable trajectory nozzle, the nozzle base assembly 20 may also include one or more additional openings. As shown in FIGS. 3A–3C, one or more secondary openings 52 may be positioned adjacent to the variable trajectory nozzle 34. These secondary openings 52 could include nozzles, as seen in FIG. 4A, with pre-set, non-adjustable trajectories that are configured to complement the irrigation scheme of the variable trajectory nozzle 34 and, thereby, optimize water distribution of the sprinkler system 10. Each secondary opening 52 is a tubular shaped member having a water inlet end positioned near the interior of the nozzle base housing 20 and a water outlet end located within an opening 54 along the sidewall of the nozzle base housing 20. If desired, a cap or plug (not shown) may be attached to the water outlet end of one or more secondary openings 52 or nozzles within said openings on the nozzle base assembly 20. This feature allows a user of the device to further tailor and provide additional control over the water-throwing characteristics of the sprinkler system.

In an alternate embodiment, the secondary openings 52 may also be configured to include adjustable trajectories (not shown). In this regard, the nozzle base assembly 20 is configured to include multiple adjustable trajectory nozzles. As discussed above, the trajectory of each adjustable trajectory nozzle may be set by rotating the rod-shaped trajectory adjuster in a clockwise or counter-clockwise direction until the water discharge end of the nozzle is oriented in the desired upward or downward trajectory.

The advantages of being able to adjust the trajectory of the water stream thrown by the nozzle body 34 are numerous. For example, adjustable trajectory sprinklers allow the user to select or adjust the water trajectory without having to install different nozzles on the sprinkler. In addition, this sprinkler configuration also enables irrigation coverage of various sizes without adversely affecting water flow rates. Other advantages not specifically described herein but known by those skilled in the art are also included within the scope of the present invention.

Automatic Breakup Screw

Referring to FIGS. 4A–4C, the nozzle base assembly 20 may also include a radius adjustment or stream breakup screw 56 threaded in the outwardly extending cavity 30 formed within the housing sidewall 28 near the water outlet end of the nozzle body 34. The stream breakup screw 56 is used on the sprinkler system 10 to divide the stream of water into smaller droplets for optimal watering. To prevent the breakup screw 56 from interfering with the maximum water trajectory and/or throw-radius of the sprinkler, the breakup screw 56 is positioned to automatically affect mainly lower-angle trajectories. As discussed in greater detail below, the breakup screw 56 may also be adjusted to control the particular angle at which the water breakup starts to occur.

Rotating the breakup screw 56 in a counter-clockwise or clockwise direction moves the screw 56 up or down within the opening of the housing sidewall 28. This, in turn, adjusts the height or length of the screw 56 extending into the opening 30 and, in some instances, into the water throw-path of the nozzle 34. Thus, by adjusting the height of the stream breakup screw 56, a user can control the particular angle at which water breakup starts to occur. For example, referring to FIG. 5, if a user adjusts the height of the breakup screw to X, water breakup will occur when the variable trajectory nozzle 34 is pivoted to a trajectory angle of Y. To further increase or decrease the trajectory angle at which water breakup occurs, the user simply increases or decreases the height of the breakup screw 56 within the nozzle base assembly 20.

By varying the height of the stream breakup screw 56, a user can control the particular trajectory angle, and thereby throw radius, at which water breakup will occur. Since turf erosion is greatest at the lower angle water trajectories due to the direct impact and force of the water stream on the ground, the stream breakup feature is mainly active at, and most beneficial when set to interfere with, the lower trajectory angles of the water stream. As such, this particular configuration of the stream breakup feature does not compromise the higher trajectory angles and, thereby, the maximum throw-radius of the sprinkler system.

As seen in FIG. 4A, the breakup screw 56 is positioned at the bottom of opening 30, in front of the lower portion of nozzle 34 and independent of the variable trajectory of nozzle 34. Thus, when the nozzle 34 is angled upward, the water stream will likely miss the breakup screw 56. However, when the nozzle 34 is angled to a lower trajectory, the breakup screw 56 interrupts the water stream by varying amounts, depending on the adjusted height of breakup screw 56. In this manner, the breakup screw 56 automatically breaks up the water stream directed to areas closer to the sprinkler which would be otherwise unevenly distributed.

Stator Turbine Assembly

Figure 6A:
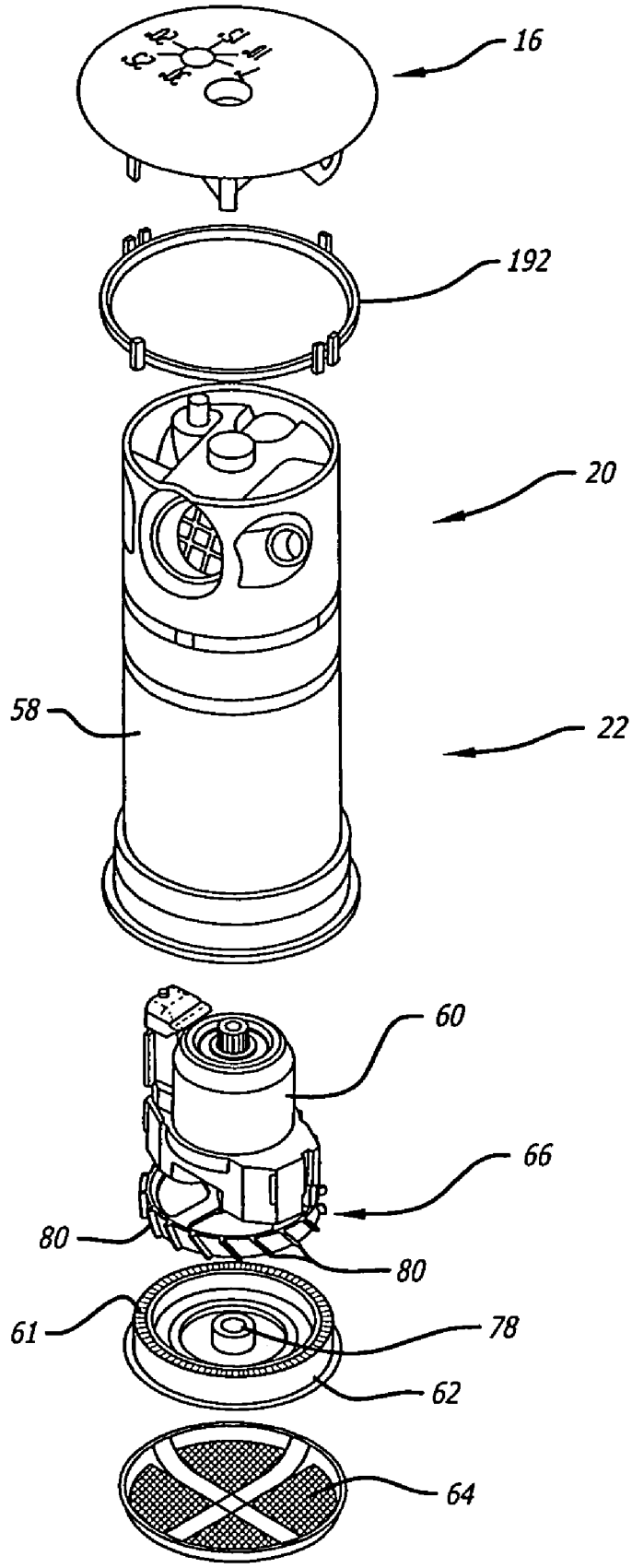
FIG. 6A illustrates an exploded perspective view of a riser assembly in accordance with the present invention.
Figure 6B:
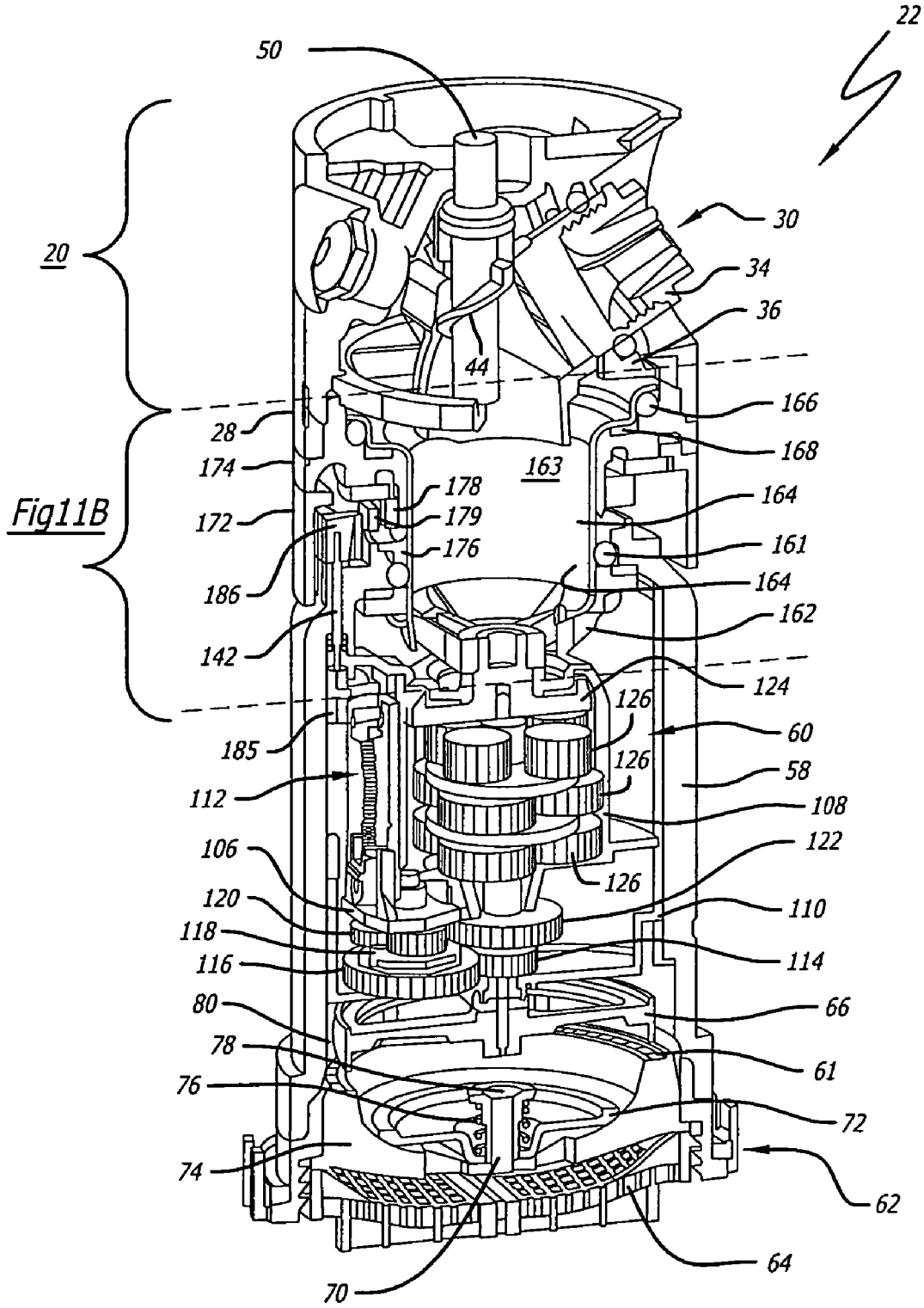
FIG. 6B illustrates cross sectional perspective view of a riser assembly in accordance with the present invention

Referring to FIGS. 1C, 6A, and 6B the riser body assembly 22 of the sprinkler system 10 includes a cylindrically-shaped, non-rotatable body 58 that houses a rotary drive assembly 60 for rotating the nozzle base assembly 20 about a substantially vertical axis of the sprinkler. Located beneath the rotary drive assembly 60 are a stator assembly 62 and a screen 64. The screen 64, which is positioned near the fluid in-flow end of the sprinkler, prevents or greatly reduces the amount of debris, sand and sediment suspended in the water supply from entering into the water flow passage of the sprinkler and potentially clogging or abrading internal sprinkler components.

Adjacent the screen 64 is the stator assembly 62. In general, the stator assembly 62 controls fluid flow to the turbine 66 of the drive assembly 60, which drives the gear train 68 and causes rotation of the nozzle 20. As shown in FIG. 6B, the stator assembly 62 includes a rivet 70, a stator 74, a valve disc 72, a spring 76 and a spring retainer 78. The rivet 70 and spring retainer 78 function to maintain the stator 74 at a fixed position yet permit the spring 76 and valve disc 72 to move along the longitudinal axis of the stator assembly 62 in response to fluid flow and velocity which, thereby, have an affect on the speed of nozzle rotation.

A preferred embodiment of a turbine assembly design in accordance with the present invention may also been seen in commonly owned U.S. patent application Ser. No. 10/302,548 filed Nov. 21, 2002 entitled Constant Velocity Turbine And Stator Assemblies, the contents of which are hereby incorporated by reference.

During operation when fluid flows through the sprinkler system, the valve disc 72 remains fully seated within the base portion of the stator 74 (e.g., in a closed position) and prevents fluid from flowing through the base portion openings. In this configuration, all fluid is channeled to flow through the apertures 61 located in the perimeter of wall portion of the stator 74 and in direct alignment with the turbine blades 80, located on the outer perimeter of turbine 66. Fluid flowing against the turbine blades 80 causes rotation of the turbine 66 which, in turn, causes rotation of the sprinkler nozzle base 20. However, because sprinkler systems are subject to variations in fluid flow, increased flow rates through the wall portion openings of the stator assembly 62 not only increase speed of rotation of the turbine blades 80 but also increase speed of nozzle base 20 rotation, thereby producing inefficient and ineffective irrigation.

To maintain constant nozzle rotation when the sprinkler is subject to increased fluid flow or velocity, excess water flow (e.g., water flow that is not required to drive the turbine and maintain nozzle rotation) is bypassed around the blades 80 of the turbine 66. This is accomplished via the valve disc 72. When the pressure differential across the wall portion openings of the stator 74 generated by the increased fluid flow and velocity is greater than the amount of force exerted by the spring 76 on the valve disc 72, the valve disc 72 opens or moves away from the base portion openings of the stator 74 thereby compressing the spring. As a result, a portion of the fluid flows through the center base portion openings of the stator 74, thereby bypassing the outer perimeter blades 80 of the turbine 66 and reducing fluid flow through the wall portion openings of the stator 74 back to initial flow rates.

Bypass Stop on Stator

Figure 7A:
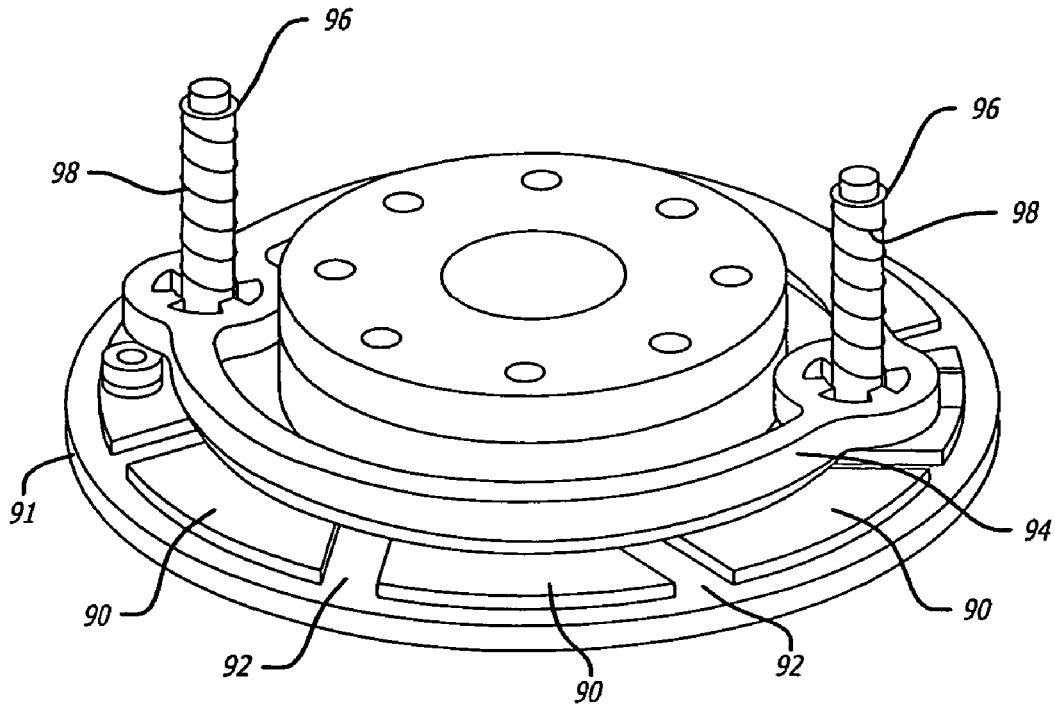
FIG. 7A–7B illustrates an embodiment of a bypass stop on a stator in accordance with the present invention.
Figure 7B:
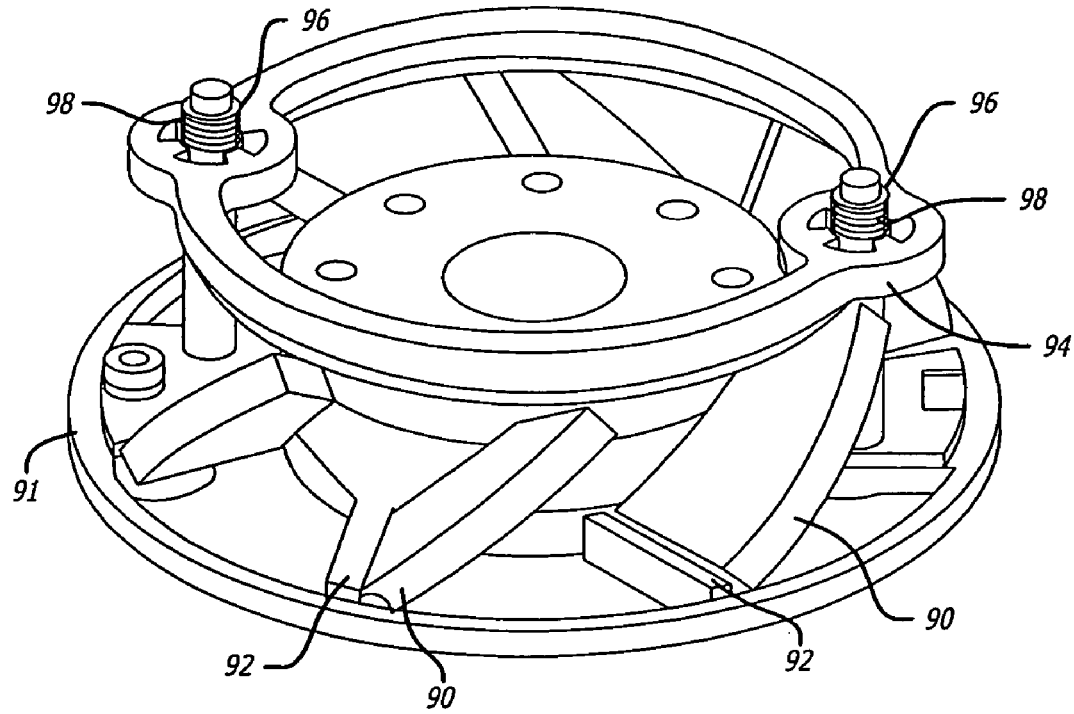

An alternate embodiment of a stator housed within the riser body assembly of the present invention is shown in FIGS. 7A and 7B. As discussed above, the purpose of the stator 91 is to regulate the flow of water to the turbine 66 across a range of flow rates and pressures. This is accomplished by varying the flow area of a parallel flow path called the bypass flow area. As shown in FIGS. 7A and 7B, the stator 91 includes six movable reeds 90 that pivot about their "living" hinge joints 92 that initially cover the bypass flow area. The bypass stop 94, which is coupled to the stator 91 by way of two retaining washers 96 and two springs 98, determines the position of the movable reeds 90 and thus determines the bypass flow area. When water flow increases, the reeds 90 are pushed open against the bypass stop, which then transfers the forces to the springs 98. This increases the bypass flow area and, thereby, also increases the water flow to the bypass area. As such, water flow to the turbine is allowed to remain substantially constant over a range of flow rates and pressures.

In general, the plane of the reeds 90 is initially perpendicular to the direction of fluid flow. As the reeds 90 pivot, the plane of the reeds 90 approaches an orientation that is parallel with respect to the direction of flow, allowing a larger bypass range than is possible with conventional plunger type stators. With this pivoting reed-type stator, the bypass flow area can be increased up to 80% of the total area of the stator 91, allowing for maximum bypass water flow.

Previous designs have utilized molded-in stators, with the limitation being the change in spring rate of the plastic because of the inherent property of plastics to creep over time. This change in spring rate caused the regulation of the bypass flow area to vary over time, thereby affecting the water flow to the turbine. To overcome this problem, the current invention utilizes metallic springs 98 to regulate the bypass flow, thus eliminating the creep issue associated with plastic parts.

Reversing Cluster Gear Planetary Drive with Uni-Directional Turbine

As shown in FIGS. 8A–8G, the rotary drive assembly 60 includes a gearbox 100 coupled to a uni-directional turbine 66. The gearbox 100 includes a planetary drive 102 at the high torque or output end of the gearbox 100 that is combined with a reversing gear train having cluster gears 104 at the low torque end of the gearbox 100. This configuration enables the gearbox 100 to drive the nozzle base assembly 20 in two directions with high torque using motion transmitted from the low torque, high-speed uni-directional turbine 66. By using a unidirectional turbine 66, the planetary drive 102 is more efficient compared to prior art planetary drives which use reversing turbines. In addition, positioning the planetary drive 102 at the high torque end of the gearbox 100 provides a more robust design compared to prior art devices which use cluster gearing, thereby requiring more tolerance sensitive parts due to the unbalanced loads of the gears and bearings. An example of a prior art device having a reversing gear mechanism is disclosed in U.S. Pat. No. 5,673,855, the entirety of which is incorporated herein by reference.

Referring to FIGS. 8A–8G, the rotary drive assembly 60 is configured to rotate the nozzle base assembly 20 (not shown) first in one direction and then reverse the nozzle base assembly 20 so that it rotates in the opposite direction. This oscillating rotation is achieved by shifting a reversing gear plate 106 located within the gear train of the reversing gear assembly 60 at a point near the turbine 66 where the torque is low. A reversing gear case 108 located above the reversing end cap 110 is connected to the reversing gear plate 106 by a vertically extending trip spring assembly 112. As discussed in greater detail below, the trip spring assembly 112 acts on the reversing gear plate 106 to cause a shift or reversal in direction of the rotary drive and, thereby, the nozzle base assembly 20.

During operation of the reversing gear assembly 60, fluid flow through the inlet end of the sprinkler assembly flows against the turbine blades 80 causing rotation of the turbine 66. The high-speed rotating turbine 66 drives a pinion gear assembly 114, which further drives an adjacent first cluster gear 116. Located between the first cluster gear 116 and the reversing gear plate 106 are a gear plate retainer 118, several pinion 120 gears and a second cluster gear 122 configured to reduce rotational speed of the assembly.

Figure 8A:
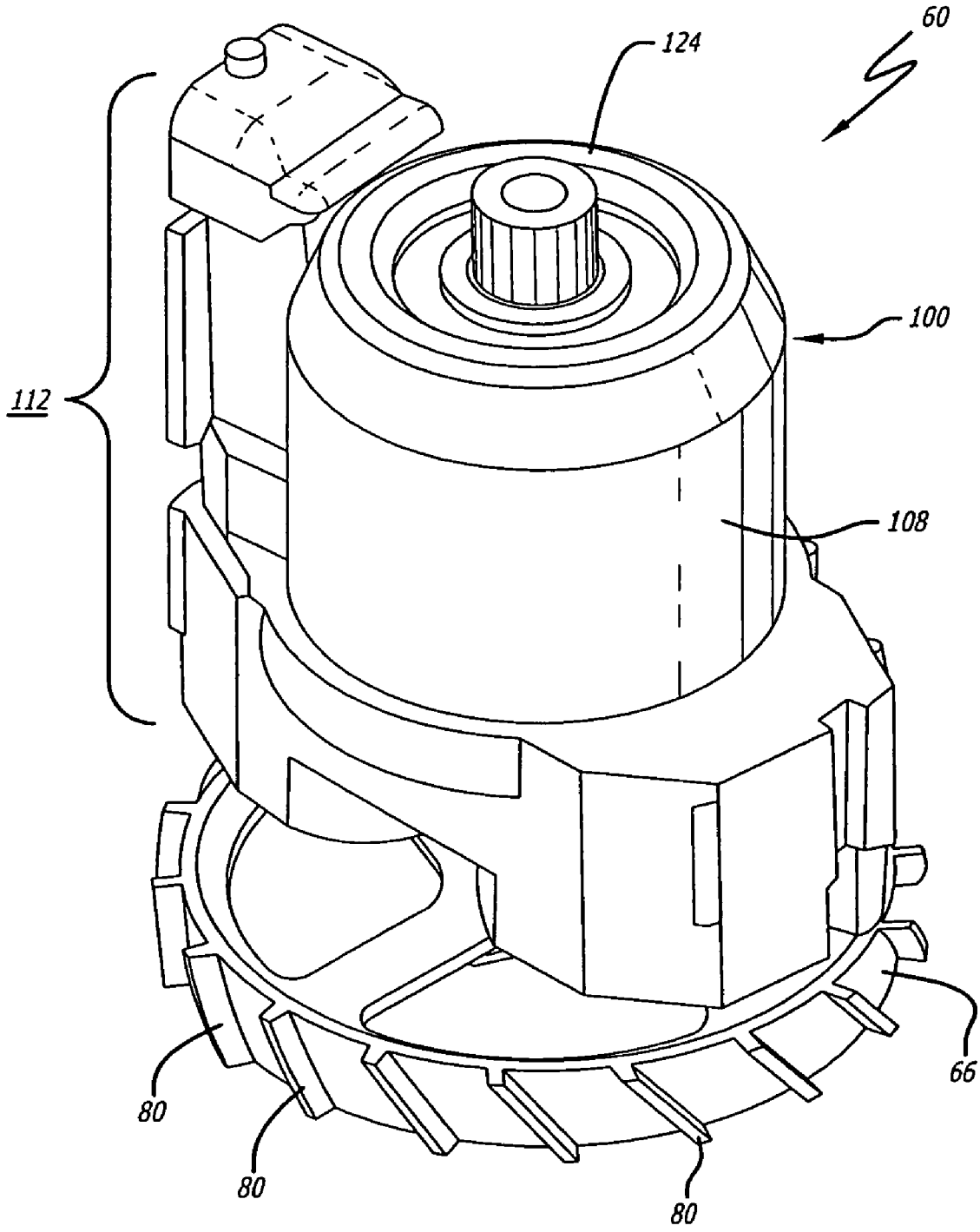
FIGS. 8A–8I illustrate an embodiment of a reversing cluster gear planetary drive with uni-directional turbine in accordance with the present invention.
Figure 8B:
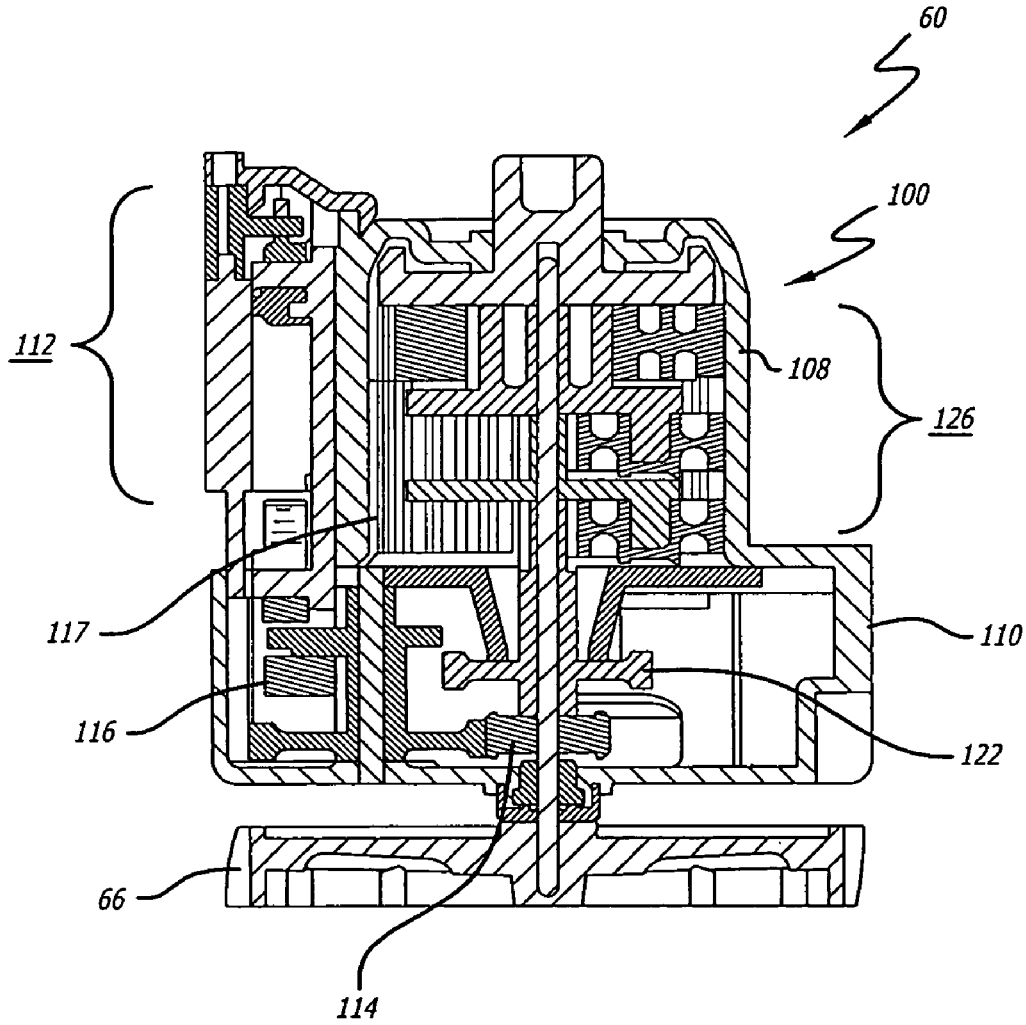
Figure 8C:
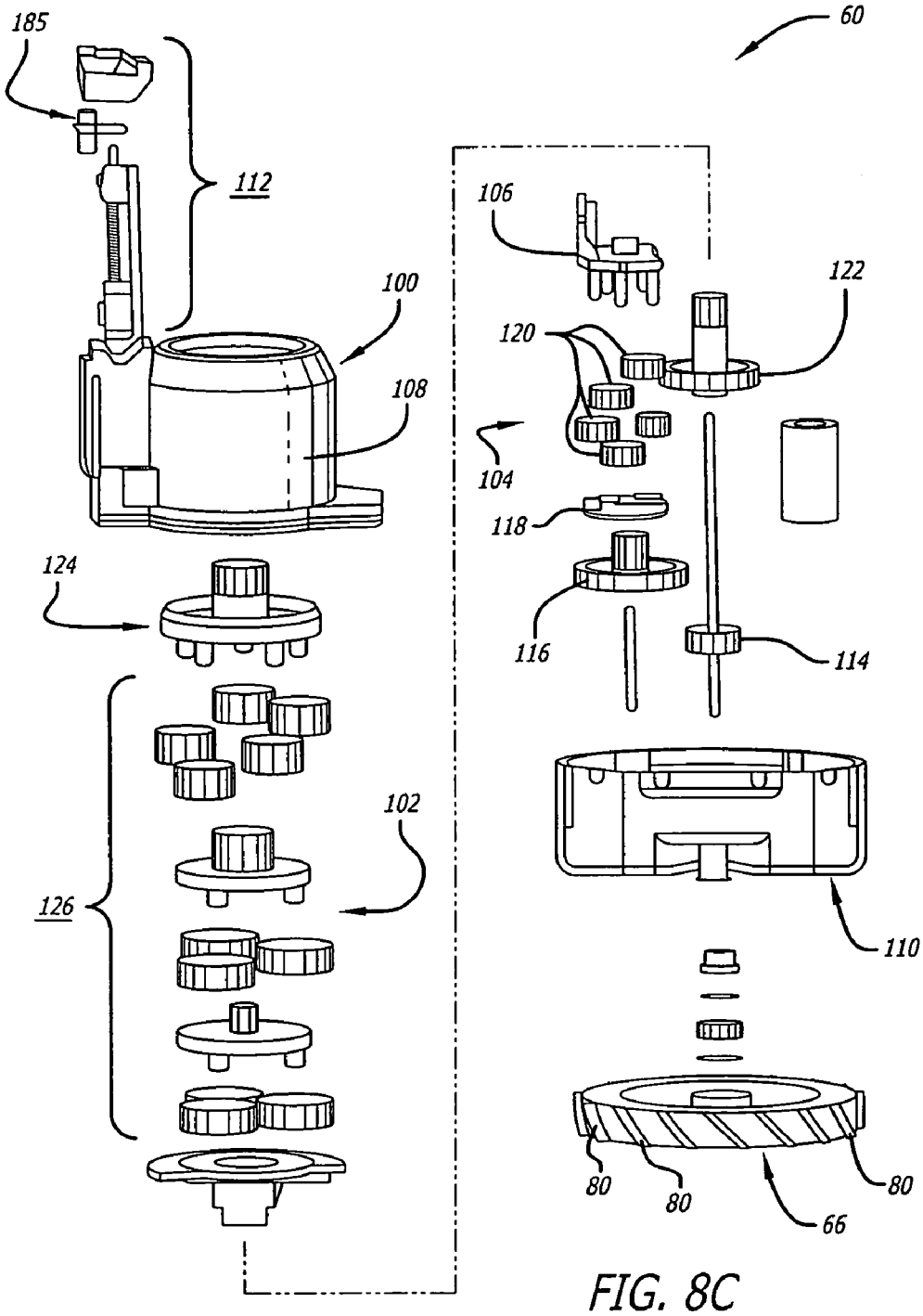
Figure 8D:
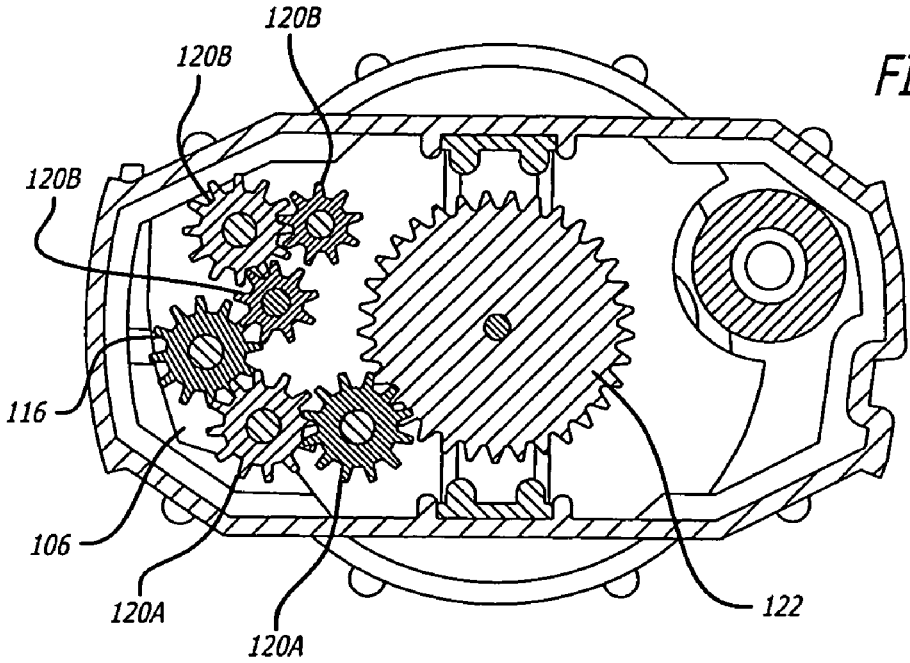
Figure 8E:
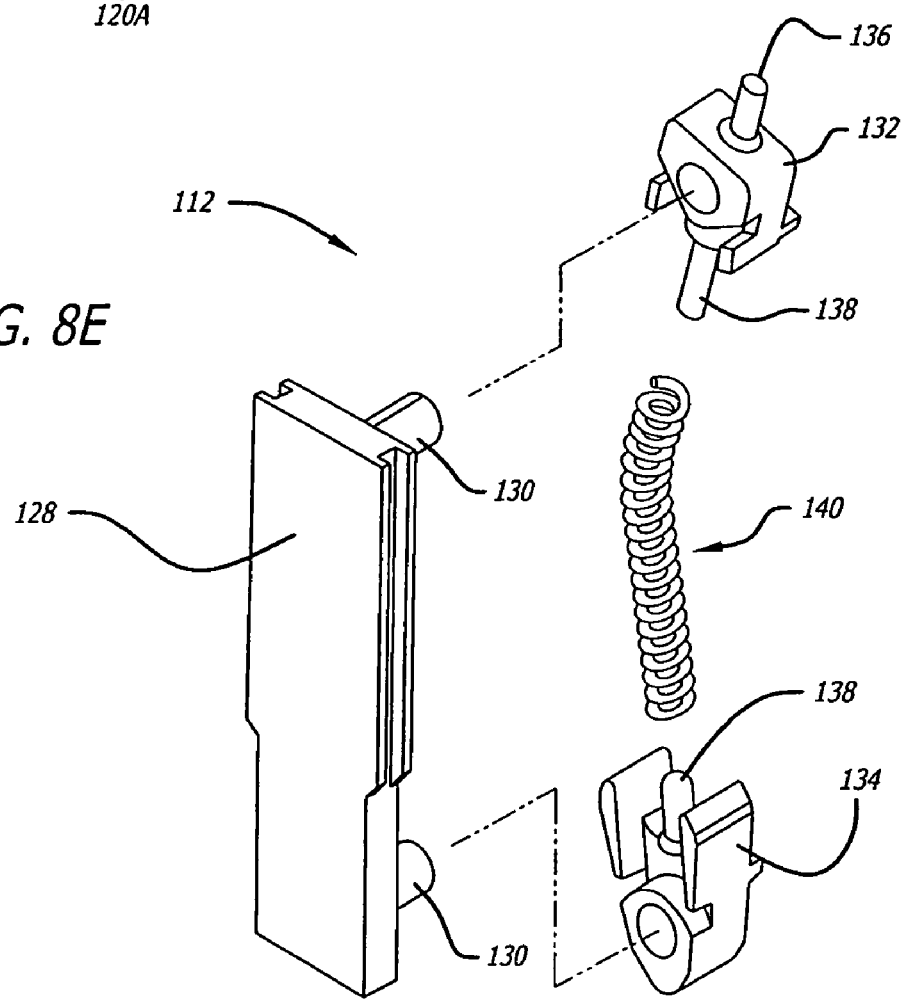
Figure 8G:
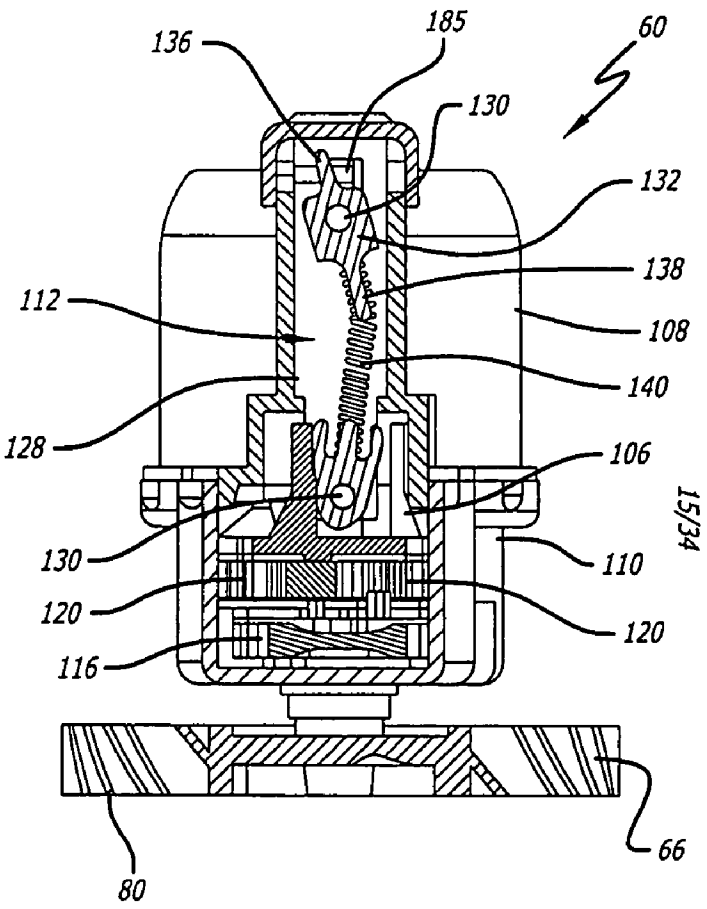
Figure 8F:
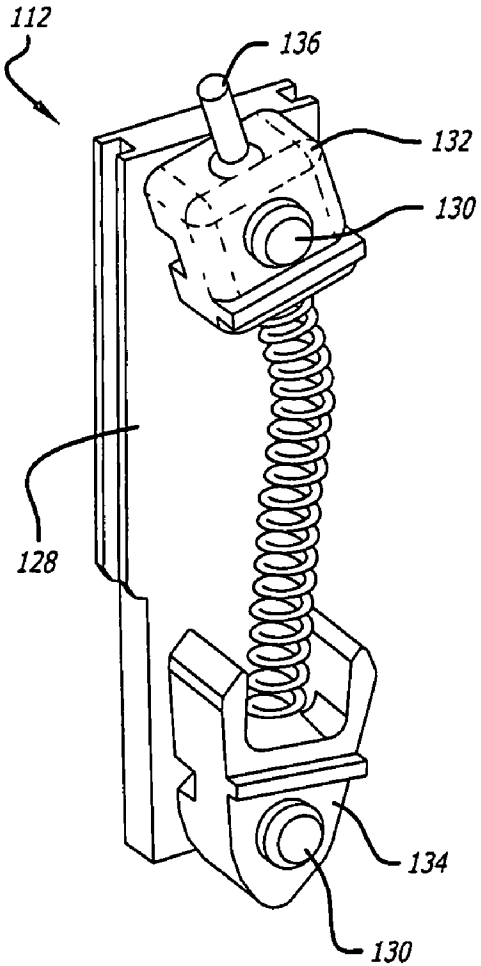
Figure 8H:
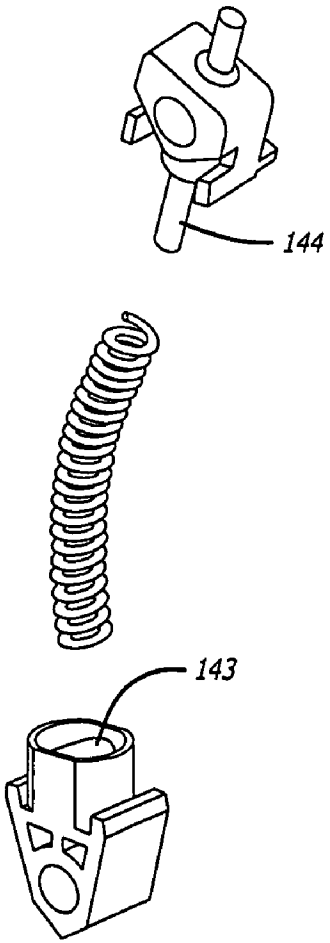
Figure 8I:
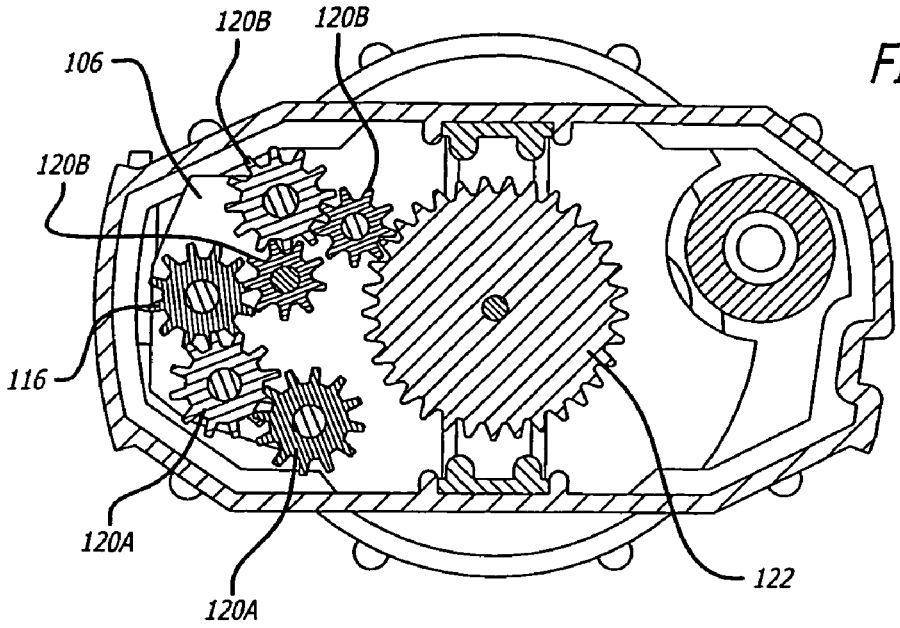

As shown in FIGS. 8C, 8D, and 8I, the top portion of first cluster gear 116 is in driving engagement with two groups of pinion gears 120*a* and 120*b*, causing both groups to counter-rotate. Although the first cluster gear 116 simultaneously engages and drives both groups of pinion gears 120*a* and 120*b*, the arrangement is such that only one of the pinion gears may be in driving engagement with the second cluster gear 122. This is due to horizontal movement of the reversing gear plate 106 that moves relative to the second cluster gear 122 and thus moves the two groups of pinion gears 120*a* and 120*b* closer to or further away from second cluster gear 122. Note that pinion gears 120*b* have three gear components while pinion gears 120*a* have two gear components, thus allowing the end gear of each group 120*a*, 120*b* to rotate in a different direction. In this manner, pinion gears 120*a* and 120*b* alternate engagement with the second cluster gear 122, rotating the second cluster gear 122 in a different direction with each alternate engagement.

Located between the second cluster gear 122 and an output carrier 124 are several sets of planetary gears 126. The planetary gears 126, which are driven by the second cluster gear 122, engage the notched interior wall 117 of the reversing gear case. Oscillating rotation of the toggle tripper 185 about a vertical axis causes the trip spring assembly 112, discussed in greater detail below, to buckle back and forth between oppositely disposed over center positions. This in turn causes the reversing gear plate 106 to shift back and forth between one of two different drive positions, seen in FIGS. 8D and 81. In one drive position, the reversing gear plate 106 interposes a first pinion gear 120*a* into the gear train to achieve rotation of the output carrier gear 124 in a first (e.g., clockwise) direction. In the other drive position, the reversing gear plate 106 interposes a second, oppositely rotating pinion gear 120*a* into the gear train to achieve rotation of the output carrier gear in a second opposite (e.g., counter-clockwise) direction.

As shown in FIG. 8E-8H, the trip spring assembly 112 includes a base plate 128 having spaced pivot pins 130 extending to one side of the base plate. An upper pivot member 132 is pivotally journalled around upper pivot pin 130 and a lower pivot member 134 is pivotally journalled around a lower pivot pin 130. Upper pivot member 132 includes an upwardly extending rod 136 that extends into an opening in the reversing gear case 60. As such, movement of the reversing gear case 60 acts on the upper pivot member 132 to toggle or pivot the upper pivot member 132 about the upper pivot pin 130. Lower pivot member 134 includes a downwardly extending rounded end which engages the reversing gear plate 106 to toggle the gear plate 106 back and forth and, thereby, alternately reverse the rotation of the rotary drive.

The facing surfaces of the upper and lower pivot members include facing dowels 138 on which the ends of a typical compression spring 140 are received. Thus, when the upper pivot member 132 is toggled by movement of the toggle tripper 185, best seen in FIG. 6*b*, lower pivot member 134 will eventually pivot. As upper pivot member 132 passes over the center of upper pivot pin 130, upper pivot member 132 acts on the top end of compression spring 140, eventually causing the spring 140 to flip over to one of its two oppositely buckled, stable positions. As the spring buckles, the flipping action of the spring 140 will pivot or toggle the lower pivot member 134 about the lower pivot pin 130. This, in turn, pushes the reversing gear plate 106 causing a shift or reversal in direction of the rotary drive and, thereby, the nozzle base assembly 20.

A preferred embodiment in accordance with present invention in this regard may also be seen in commonly assigned and copending U.S. patent application Ser. No. 10/455,868, filed Jun. 5, 2002 entitled Rotary Sprinkler With Arc Adjustment Guide And Flow Through Shaft, the contents of which are hereby incorporated by reference.

Over Center Stator Mechanism

In an alternate preferred embodiment of the present invention, an over center stator mechanism 150 is used to reverse the direction of rotation of the sprinkler head, as shown in FIGS. 9A–9F. Unlike reversing gear cluster of FIGS. 8A–8I, the over center mechanism 150 reverses the direction of sprinkler head 20 rotation by redirecting water flow against turbine 66 instead of a trip spring assembly 112.

Figure 9A:
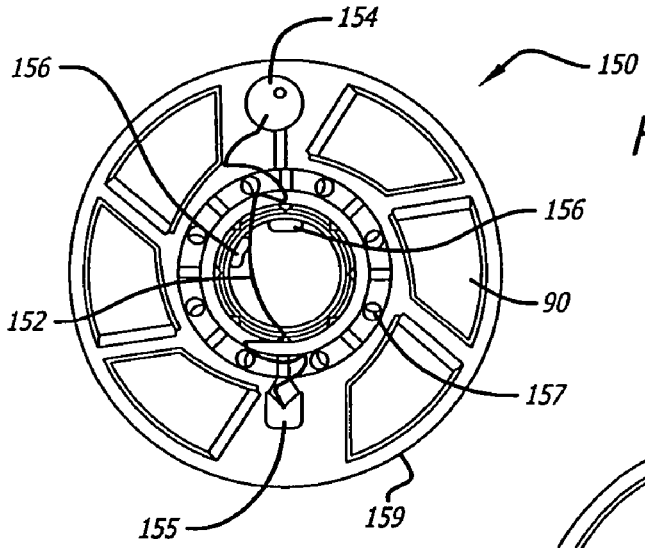
FIGS. 9A–9*f* illustrate an embodiment of an over center stator mechanism in accordance with the present invention.
Figure 9B:
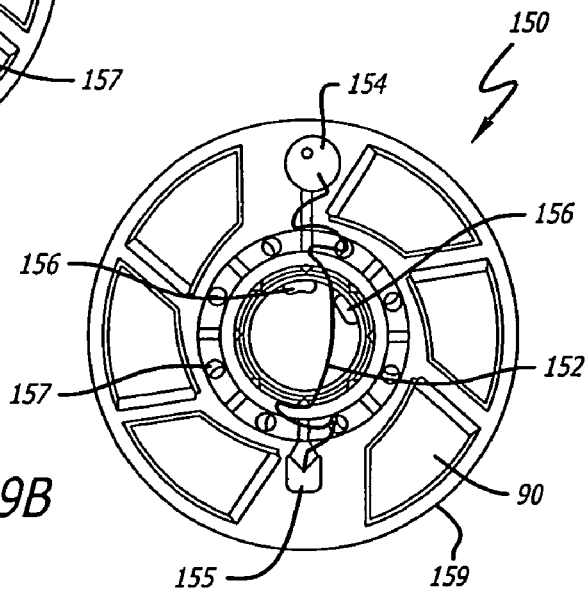
Figures 9C, 9D, 9E, 9F:
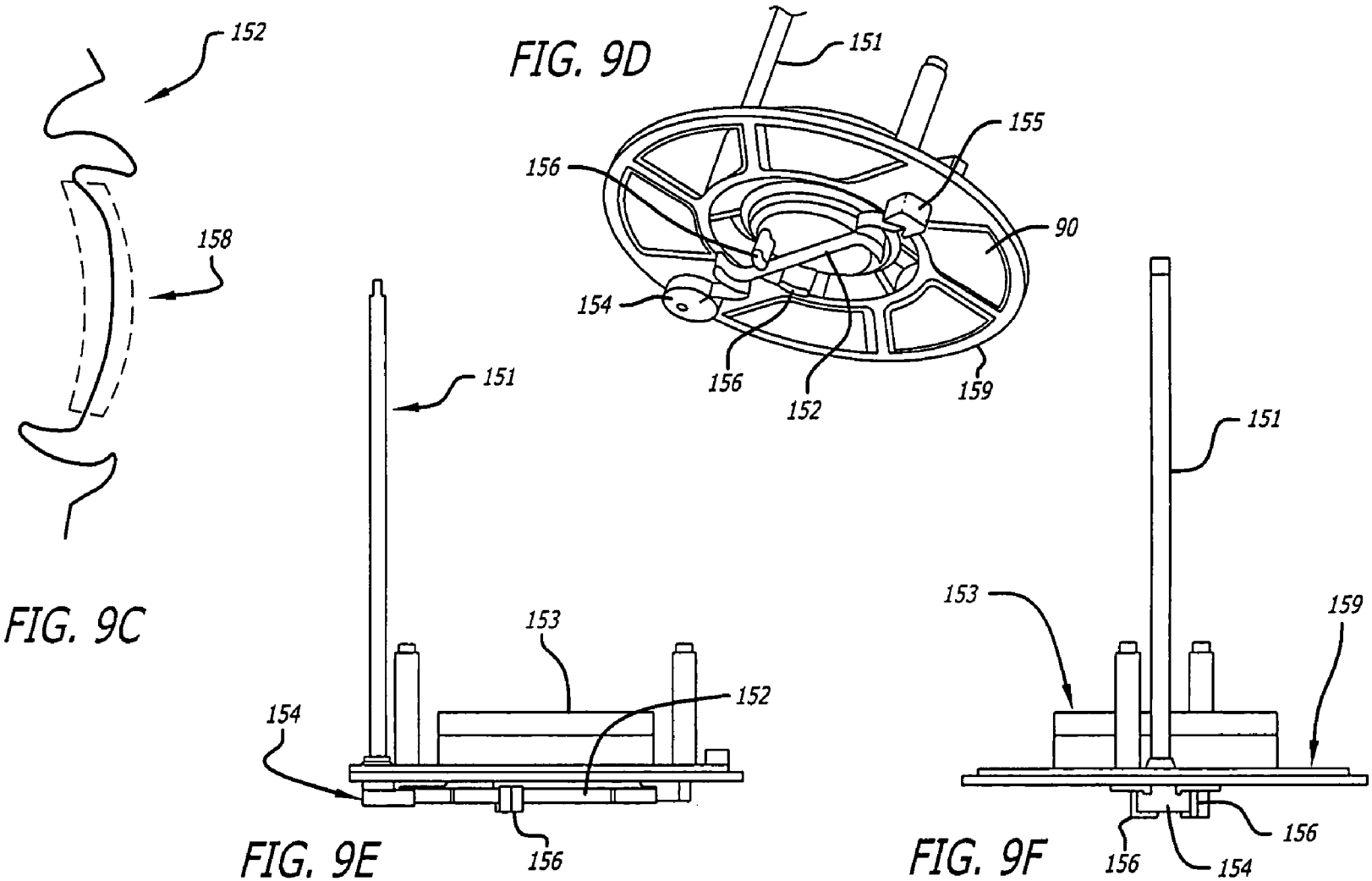

As may be apparent from FIGS. 9A and 9B, the stator 159 of over center stator mechanism 150 is consistent with the bypass stator of FIGS. 7A and 7B, having movable reeds 90 to alleviate additional water flow from driving the turbine. Although the bypass stop 94, the retaining washers 96 and springs 98 are not shown in FIGS. 9A–9F, they may be included for proper operation of the movable reeds 90.

Referring to FIGS. 6*b* and 9A–9F, the over center stator mechanism 150 is located at the bottom of a riser, in a similar position to the stator 74 beneath the turbine 66 seen in FIG. 6*b*. However, a modified turbine design is desired in conjunction with the over center stator 150 where the turbine blades are located closer to the center of the turbine. This allows the turbine blades to line up with the flow ports 157 of the stator 159.

In place of the trip spring assembly 112 discussed below, the trip arm 186 of the adjustable arc mechanisms 170 is directly coupled to the trip shaft 151 of the over center stator mechanism 150.

An over center spring 152 is positioned between the trip arm 154 and pivot post 155 on the stator 159 of the sprinkler riser assembly 22. As the trip arm 154 rotates, it "pops" or flips the over center spring 152 between two positions, best seen in FIGS. 9A and 9B.

As the over center spring 152 pops to one of two positions, it contacts flow director posts 156 that extend from flow director 153. The flow director 153 is rotatably mounted to the stator 159, having flow directing apertures 157 positioned around the flow director 153 which line up with flow ports within the stator 159. The flow director 153 rotates slightly in either direction, changing the alignment of the flow directing apertures 157 with the stator 159 flow ports. As this alignment changes, the angle of water flow through the stator 159 changes, contacting the turbine 66 at a different angle and thus changing its direction of rotation. In this manner, the direction of rotation of turbine 66 is changed as the flow director 153 is rotated.

The trip shaft 151 couples to the arc adjustment mechanism 170 of the system (discussed below), allowing the trip shaft 151 to rotate when the arc adjustment mechanism 170 is triggered. As the trip shaft 151 rotates, the trip arm 154 also rotates popping the over center spring 152 into its alternate position, contacting the flow director post 156. Since the flow director post 156 is connected to the flow director 153, the angle of water flow through the stator 159 is redirected against the turbine, changing the turbine's direction of rotation, and consequently the direction of the sprinkler head's 20 rotation.

Nozzle Base Clutch

Figure 10:
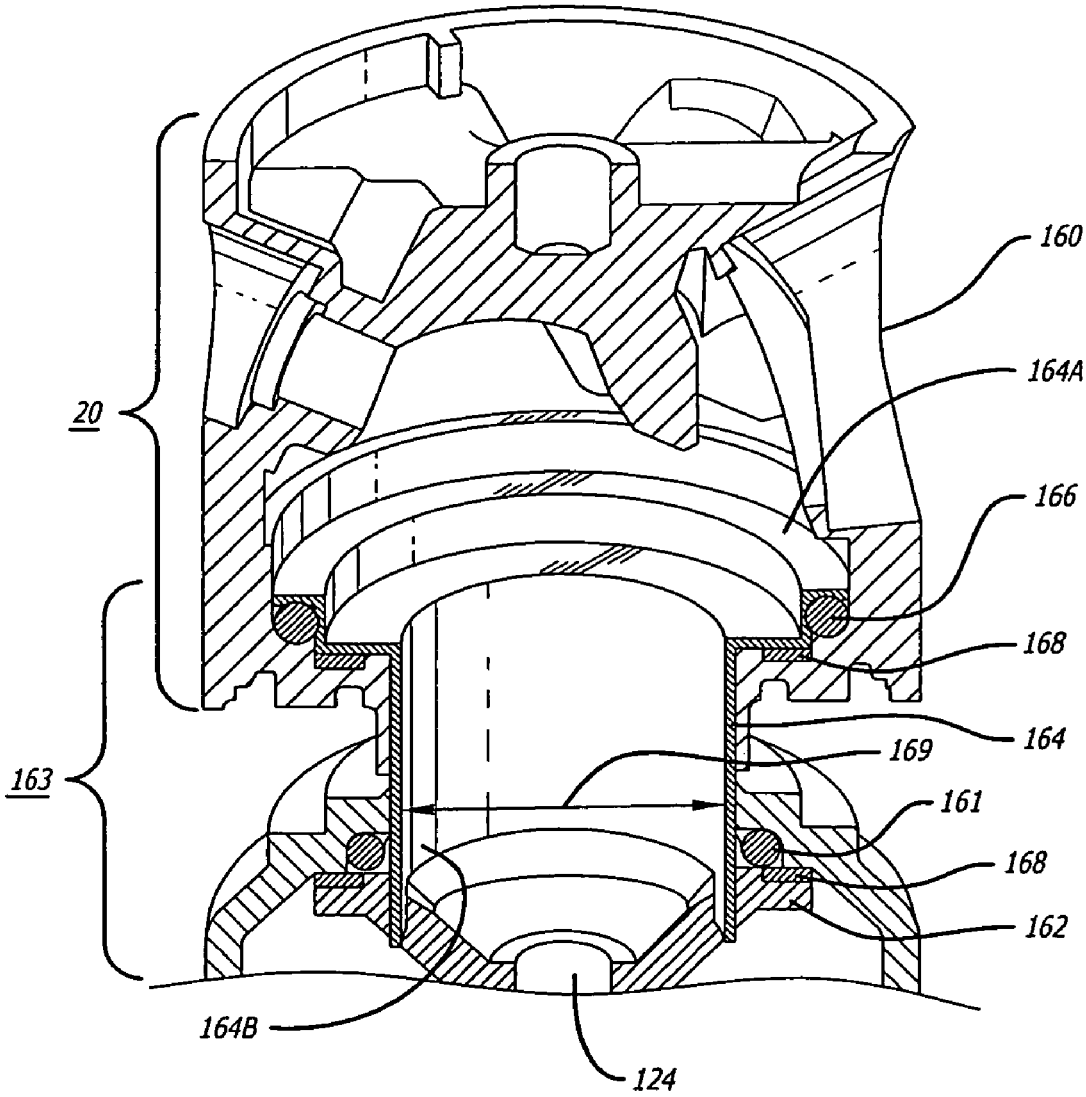
FIG. 10 illustrates an embodiment of a nozzle base clutch in accordance with the present invention.

Referring to FIGS. 6*b* and 10, a nozzle base clutch 163 provides a clutch mechanism linking the output drive 124 to the nozzle assembly 20, yet allowing the nozzle assembly 20 to be rotated independently of the output drive 124 under certain conditions. Although the nozzle base clutch 163 is secured to the riser assembly 22, the nozzle base assembly 20 is "clutched" by two parallel friction paths between the nozzle base tube 164 and the nozzle base 160 that couples the two parts. The first friction path is the compression of o-ring 166. The second friction path is between the nozzle base tube 164 and the Teflon washer 168.

The o-ring 166 provides friction in both static and pressurized conditions. On the other hand, the friction between the nozzle base tube 164 and Teflon washer 168 is only present when the nozzle base 160 is pressurized. When an external torque applied to the nozzle base 160 is greater than the torque created by the two parallel friction paths, the nozzle base 160 rotates with respect to the nozzle base tube 164, allowing the nozzle base 160 to advance to the arc limits.

Referring to FIGS. 6*b* and 10, the drive assembly 60 is engaged with the nozzle base clutch 163 by way of the output drive 124 which is engaged with nozzle base retainer 162. Nozzle base retainer 162 is larger than the riser aperture 169 and further has a riser o-ring 161 to allow for sealing around the perimeter of the riser aperture 169. In this manner, when output drive 124 rotates, so does nozzle base retainer 162 without leaking water outside the sprinkler.

Referring to FIGS. 6*b* and 10, the lower end 164*b* of nozzle base tube 164 is fixed to the top of nozzle base retainer 162 while the upper flange 164*a* end of nozzle base tube 164 freely sits within the nozzle base assembly 20. As best seen in FIG. 10, the nozzle head o-ring 166 is secured to the underside perimeter of the upper flange 164*a* of the nozzle base tube 164 to prevent water leakage. Similarly, Teflon washer 168 is embedded within the nozzle base assembly, under the upper flanged portion of the nozzle base tube 164 to maintain a proper friction-based connection between the nozzle base assembly 20 and nozzle base tube 164 when the sprinkler is under water pressure.

In operation, water pressure pushes the nozzle base assembly 20 upward against the upper flanged end 164*a* of the nozzle base tube 164, enhancing the parallel path, friction-based connection between the output drive 124 and the nozzle base assembly 20. As a result, the rotation of the output drive 124 translates up through nozzle base retainer 162, to nozzle base tube 164 and ultimately to the nozzle base assembly 20, which rotates in unison with the drive assembly 22.

When a user wishes to manually rotate the nozzle base assembly 20 (either when the base assembly is pressurized or non-pressurized), the nozzle base assembly 20 may be grasped and rotational force applied. When the manual rotational force applied by the user overcomes the frictional force of the Teflon washer 168 (which is higher when the base assembly is pressurized) and o-ring 166, the nozzle base assembly 20 rotates independently of the nozzle base tube 164.

This nozzle base clutch 163 design allows a user to more easily rotate the nozzle base assembly 20, particularly when the sprinkler is in operation, for example to test the position of an arc stop. Previous sprinkler designs have lacked a releasable clutch mechanism between the nozzle base assembly and the drive assembly. As a result, when a user manually rotated the sprinkler head, the gearing of the drive assembly increased the amount of force needed for rotation, which increases the chances of damaging the sprinkler mechanisms. The present clutch mechanism 163 provides a disconnect between the drive assembly 22 and the nozzle base assembly 20, requiring less force for rotation by the user, and vastly decreasing the chances of damage to the sprinkler.

The lower torque requirements afforded by the clutch mechanism in accordance with the present invention results primarily from the fact that clutching occurs after the riser seal in the nozzle base 160. Prior art devices generally have the clutching mechanism before the riser seal and, in some cases, through the drive. These prior art mechanisms require a higher clutch torque to overcome the additional resistance exerted by the riser seal and drive. These deficiencies are substantially overcome by the clutch mechanism of the present invention.

Adjustable Arc Mechanism

Figure 11A:
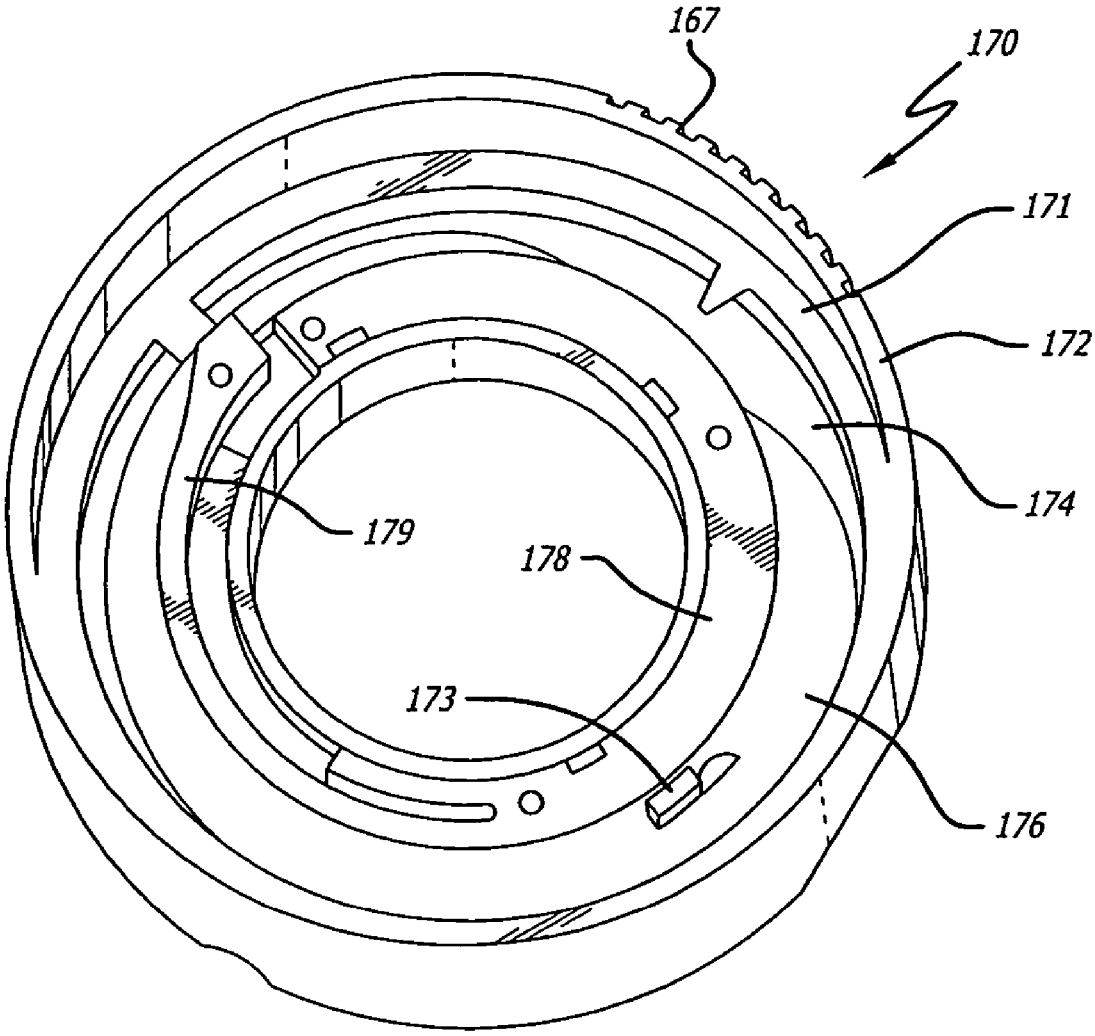
FIGS. 11*a*, 11*b* and 12 illustrate an embodiment of an adjustable arc mechanism in accordance with the present invention.
Figure 11B:
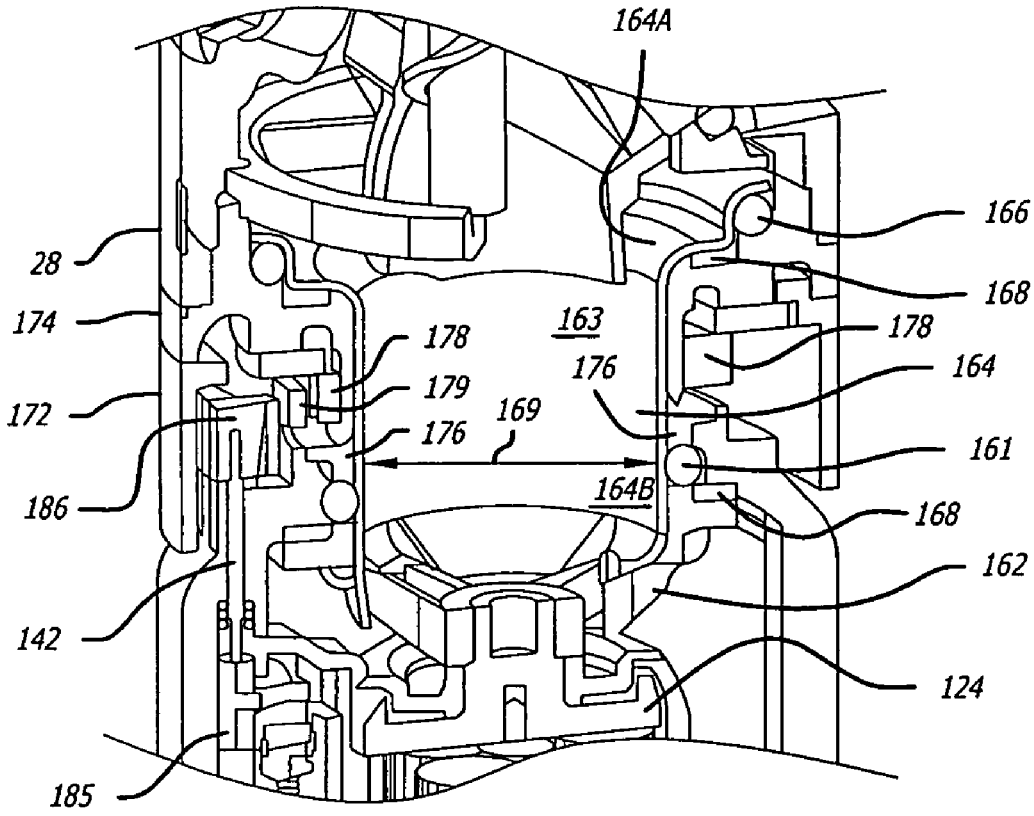
Figure 12:
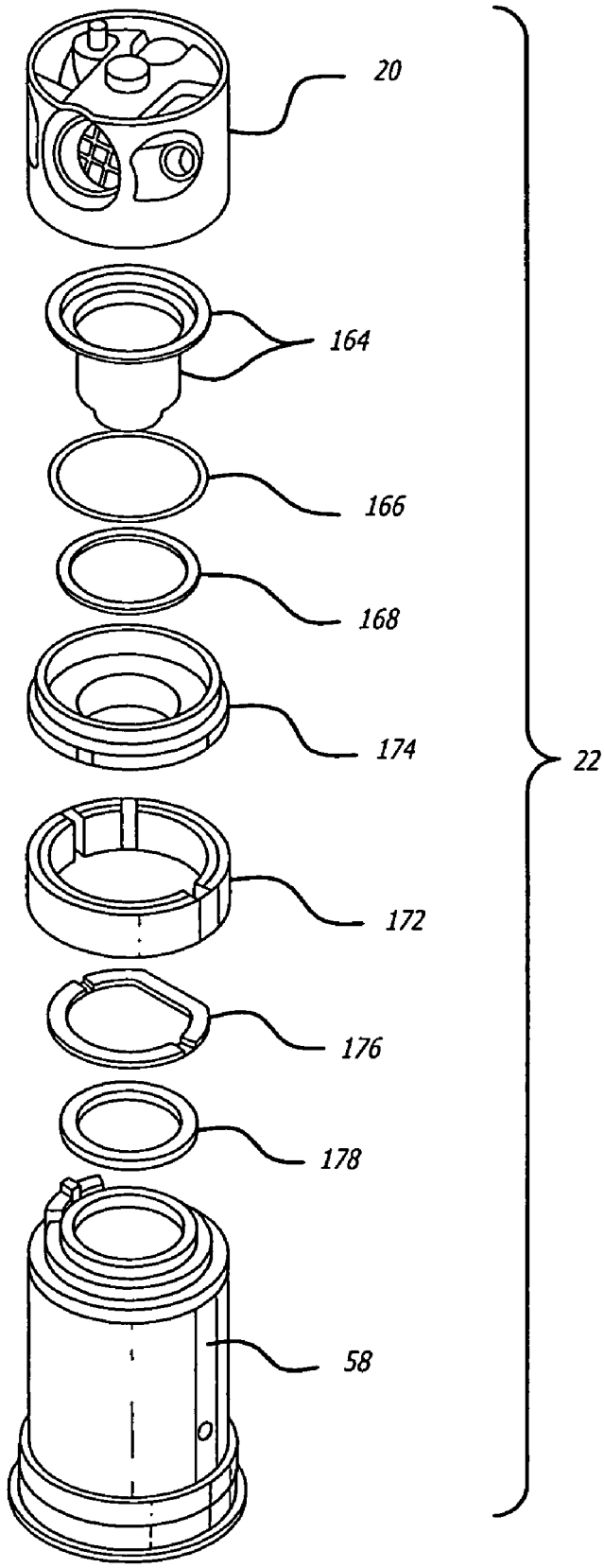

The sprinkler system of the present invention also includes an adjustable arc mechanism 170 that when set to the 360° setting allows the sprinkler to rotate in a continuous, clockwise direction. FIG. 11A illustrates the underside of the adjustable arc mechanism 170 having four main components: an arc indicator 172, a lower nozzle base 174, an adjustable stop 176, and a fixed stop 178. As shown in FIGS. 11A, 11B, and 12, an arc indicator 172 is coupled to the lower nozzle base 174 via a partial set of gear teeth 167 around the entire inside circumference of the lower nozzle base 174.

FIGS. 11*a*, 11*b*, and 12 illustrate how these components fit together. At the bottom is fixed stop 178, secured to lower nozzle base 174 and is further made up of a ring having a stop arm 179 that is biased slightly away from the center of fixed stop 178. This fixed stop 178 design is configured such that the stop arm 179 can trip a trip arm 186 only when the fixed stop 178 is rotated in a certain direction (e.g., clockwise). When rotated in the opposite direction (e.g., a counterclockwise), the configuration is such that stop arm 179 is pushed inwardly during rotation and thus moves past the trip arm 186, as shown in FIG. 11A.

Around the fixed stop 178 sits adjustable arc stop 176. Adjustable arc stop 176 is a generally circular ring having a slightly uneven shape and an arc stop 173 secured to the arc indicator 172.

As best seen in FIG. 11A, adjustable arc indicator 172 has a central aperture and a partial secondary wall 171 which forms a second circular shape. The previously mentioned fixed stop 178 and adjustable arc stop 176 fit within this smaller circle formed by the partial secondary wall 171. The adjustable arc stop 176 is positionable so as to either contact the trip arm 186 during rotation, or not contact the trip arm 186. More specifically, if the arc stop 173 is moved to a position near the outer outside perimeter of the adjustable arc mechanism 170, the arc stop 173 will contact the trip arm 186, but if the arc stop 173 is positioned closer to the inside aperture, away from the perimeter of the adjustable arc mechanism 170, the arc stop 173 will miss the trip arm 186 during rotation.

The adjustable arc indicator 172 is normally engaged with the lower nozzle base 174 by way of locking gearing on both components where they contact each other. In order to adjust the adjustable arc indicator 172, it must be disengaged from this gearing with the lower nozzle base 174 to allow turning of the adjustable arc indicator 172 to change the rotation of the adjustable arc stop 173. When the desired arc has been set, the arc indicator is released and the gearing on the adjustable arc indicator 172 and the lower nozzle base 174 become reengaged.

The adjustable arc mechanism 170 allows for two arc setting modes: partial circle, and full circle. The partial circle mode may be set by adjusting the adjustable arc indicator 172. This is achieved by disengaging the adjustable arc indicator 172 from the lower nozzle base 174 and rotating it. This moves adjustable arc stop 176 to a desired location (other than the 360 degree position discussed above). Thus as trip arm 186 contacts the flat side of stop arm 179 or arc stop 173, it reverses the rotation of the nozzle assembly 20.

The orientation of the adjustable stop 176 is determined by the position of the arc indicator 172 as discussed above. In further description in this regard, two diametrically opposed bosses on the arc indicator 172 are keyed into two slots on the adjustable stop 176. When adjusting the arc setting, the arc indicator 172 is depressed so as to disengage the gear teeth and allow relative rotation between the arc indicator 174 and the lower nozzle base 174. The adjustable stop 176 is further guided by a track (not shown) on the lower nozzle base 174 in which a boss (not shown) on the adjustable stop travels.

To set the system to the full circle mode, the adjustable arc indicator 172 is disengaged from lower nozzle base 174 and rotated until the arc stop 173 is at a position away from the perimeter of the adjustable arc mechanism (opposite of the position shown in FIG. 11A). In this setting, the arc stop is positioned sufficiently away from the trip arm 186 that the trip arm 186 will miss the arc stop 173 as the nozzle base rotates. Thus, as the nozzle assembly 20 continues to rotate past the arc stop 173, the trip arm 186 will begin to contact the outside surface of the flexible stop arm 179 and eventually push the stop arm 179 towards the center of the aperture. As a result, the trip arm 186 will never be tripped, allowing for continuous rotation by the nozzle assembly 20 in a single direction.

Prior art adjustable arc mechanisms have typically been configured such that adjustment requires increased vertical height during radial movement. This need for added vertical height is undesirable for current sprinkler packages or designs. In contrast, the present invention contemplates making arc adjustment through radial movement of the adjustable stop. As such, the adjustable arc mechanism of the present invention easily fits within the package constraints of current sprinkler designs.

Arc Limit Reinforcement Stops

Figure 13A:
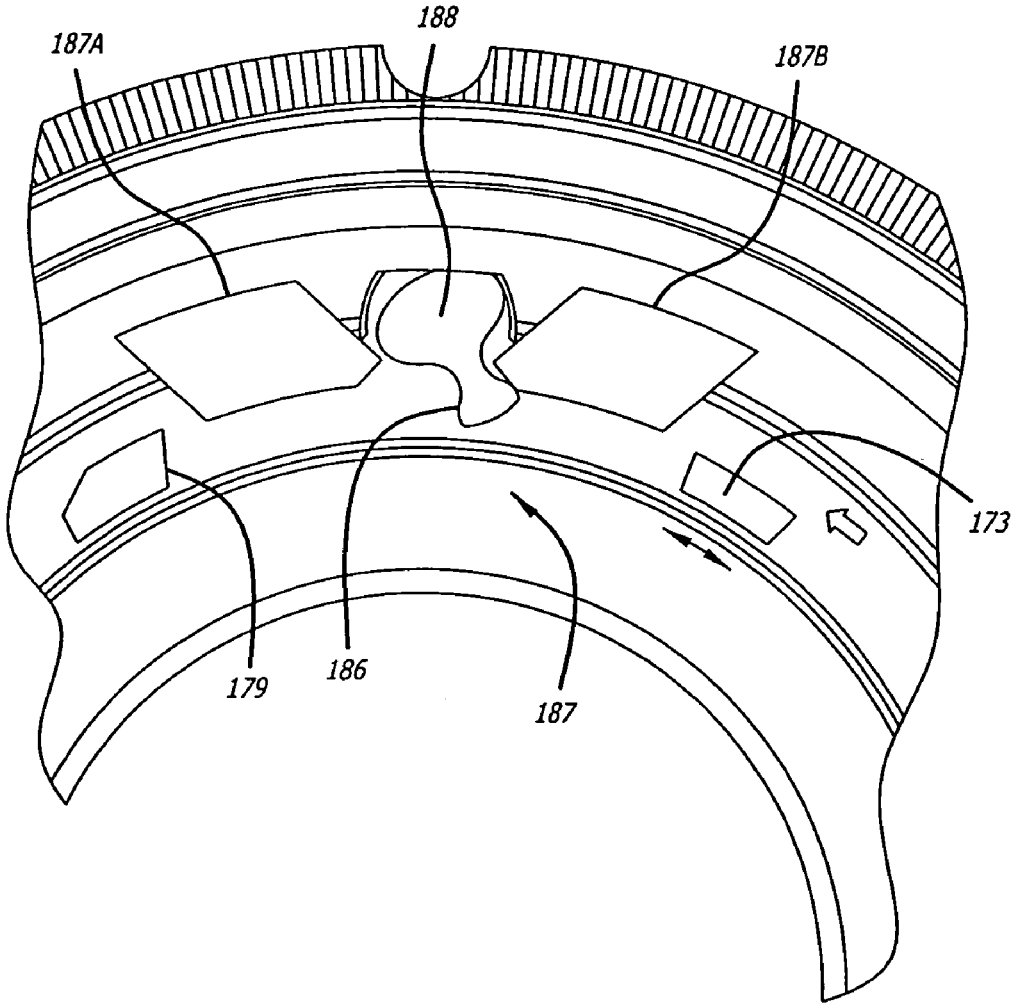
FIG. 13A–13C illustrates an embodiment of solid arc limit stops in accordance with the present invention.
Figure 13B:
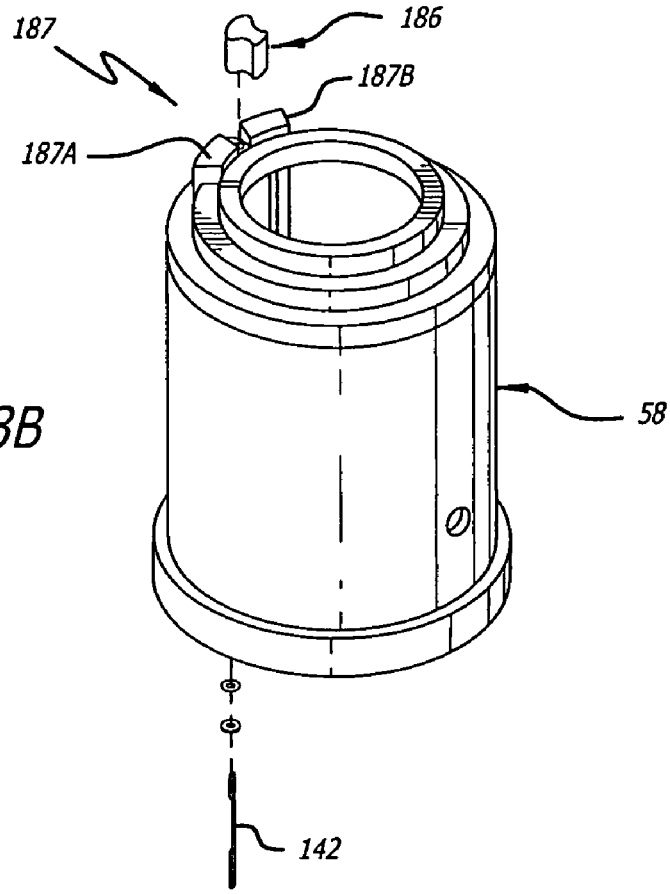
Figure 13C:
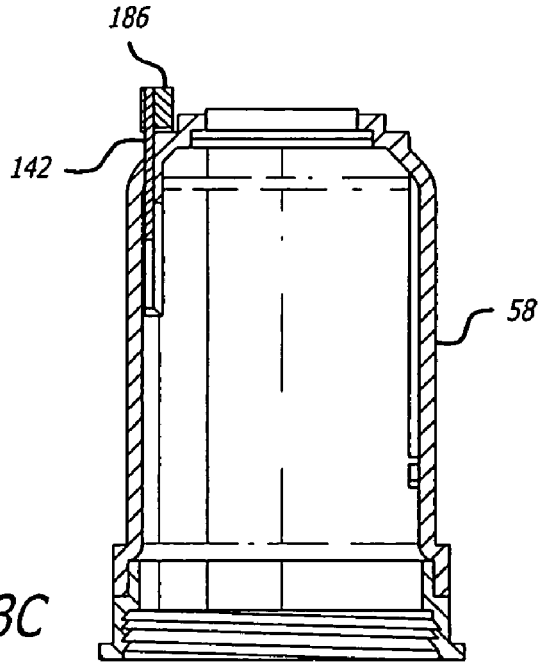
Figure 14:
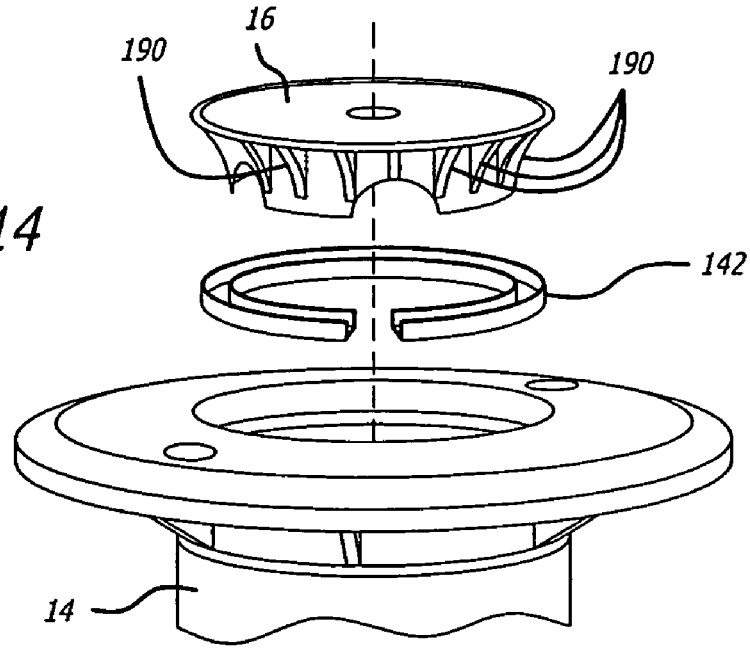
Figure 15A:
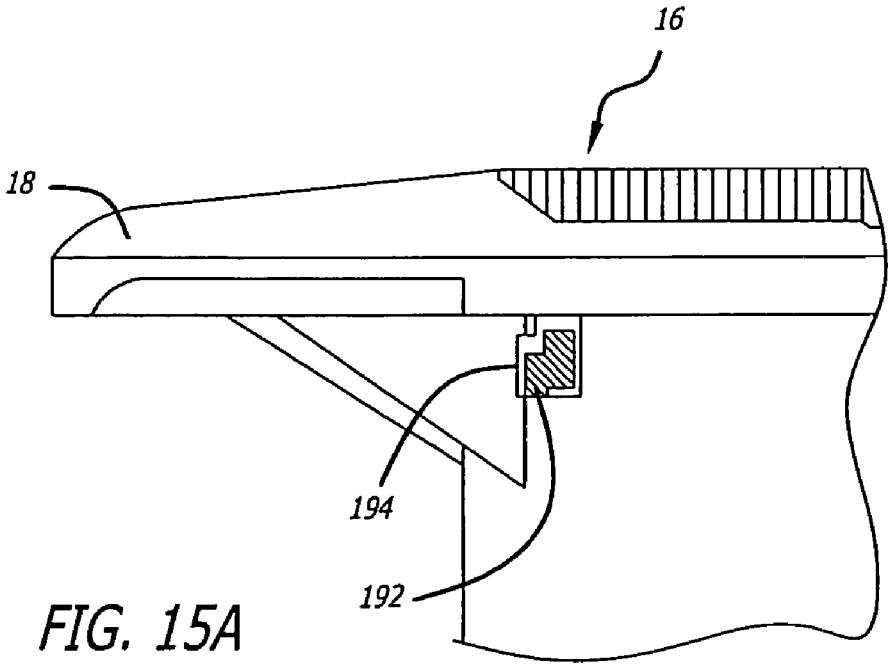
Figure 16B:
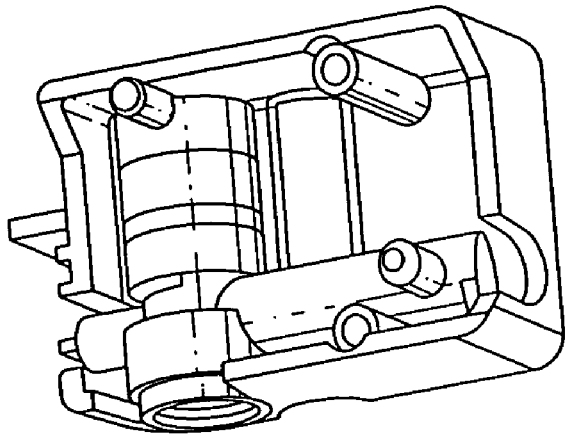
Figure 16B:
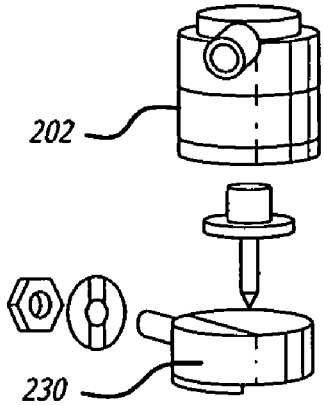
Figure 16C:
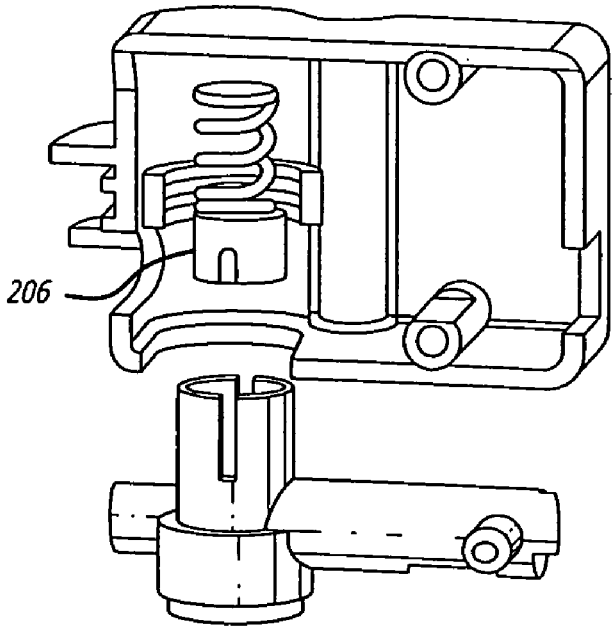

The preferred embodiment of the present invention also includes arc limit reinforcement stops 187 that help support the trip arm 186 in either of its two tripped positions. Referring to FIGS. 13A–13C, these reinforcement stops 187*a*, 187*b* have two main functions: to communicate an enhanced positive stop feel to the user when manually rotating the nozzle assembly 20 by hand, and to protect the sprinkler reversing components from damage during manual rotation of the nozzle assembly 20.

As seen in FIGS. 13A–13C, the two reinforcement stops 187*a*, 187*b* are positioned adjacent to the trip arm 186 to prevent the trip arm 186 from over turning on its pivot point 188. The trip arm 186 may be triggered by the trip stops 173, 179 shown in FIG. 13A, or other trip stop designs. Referring to FIGS. 6*b* and 13A–13C, by tripping the trip arm 186, the trip post 142 is rotated, moving the toggle tripper 185 and switching the rotation of rotation assembly 60.

During use, the trip arm 186 generally does not contact the reinforcement stops 187*a*, 187*b*. However, when the nozzle base is manually advanced to the arc limit, the trip arm 186 is forced into its corresponding reinforcement stop 187*a* or 187*b*, thereby limiting further rotation of the nozzle base. The reinforcement stops 187*a*, 187*b* act as a solid backup to the trip arm 186 to keep trip arm 186 from moving more than a few degrees beyond its normal operating position. As such, a user is able to positively verify the arc setting of the sprinkler system. In addition, the user's manual force on the nozzle assembly 20 is absorbed by the reinforcement stops 187*a*, 187*b*, the most structurally sound components in the assembly, instead of the more delicate components of the reversing mechanism. Thus, this configuration provides a more robust and accurate reversing limit setting mechanism.

Snap Ring Installation

A preferred embodiment of the present invention includes an improved snap ring 192 installation approach designed to quickly and easily secure the riser assembly 12 within the sprinkler body 14. The improved design is primarily based on the structure of the riser cap 16 and the structure of the internal opening of the sprinkler body. More specifically, the improvement is due to an insertion angle 196 on the riser cap 16 and body angles 197, 198, 199 of sprinkler body 14.

Referring to FIGS. 1A, 1B, 14 and 15A–15F, the top cap 16 of the riser assembly 12 includes one or more ribs 190 located on lower surface of the top cap 16. When the top cap 16 and snap-ring 192 are assembled onto the sprinkler body, the rib design forces the snap ring 192 into a groove 194 located within the interior wall of the sprinkler body 14. This is accomplished due to the angled ribs 190 design that creates a gap below the ribs 190 toward the interior of the sprinkler body 14 as the top cap 16 is pushed into the sprinkler body 14. Specifically, the sprinkler body 14 has three angled surfaces 197, 198, and 199 that increase at progressively steeper angles respectively. Likewise, the ribs 190 of the riser cap 16 have an insertion angle 196.

As seen in FIG. 15C, body angle 198 and riser cap angle 196 preferably form about a 7 degree angle with each other. This creates a space (as depicted in FIG. 15C) between the body angle 198 and riser cap angle 196 that increases in size towards the inside of the riser opening. This increased size towards the inside of the riser opening assists in preventing the snap-ring 192 from popping out of the sprinkler body 14 during installation. More specifically, the presence of this increased space makes it easier for the user to urge the snap ring into a position nearer the groove 94.

Then, once the snap ring has been moved so that it rests against the vertical surface 199 (Figure D), the insertion tool 195 may be removed and further movement of the snap ring into the groove 194 can be caused by vertical force down on the riser assembly.

Then, finally, to ensure the riser assembly 12 is securely in place, pressure continues to be applied to the riser assembly 12 until the user hears an audible "snap," signifying proper seating of the snap-ring 192 in the sprinkler assembly. The angled faces of the cap 16 of the riser assembly 12 and the angled surfaces of the sprinkler body are such that the cap 16 does not fully seat on the sprinkler assembly unless the snap-ring 192 is properly seated. This provides the user with a further indication as to whether the top riser assembly 12 has been properly assembled onto the sprinkler.

Adjustable Pilot Valve

Referring to FIGS. 16A–21, in yet a further aspect of the present invention, an externally bled pilot valve sprinkler 250 is illustrated, having an adjustable pilot valve 201 with visual indicia 260 on the pressure regulator. Unlike previous pilot valve designs, the adjustable pilot valve 201 can be adjusted by a pressure regulator (i.e. thumb wheel 218 seen in FIG. 18A or lever 210 best seen in FIG. 16A) which allows a user to vary the output pressure of the pilot valve sprinkler 250 based on the visual pressure indicia 260.

Figure 19:
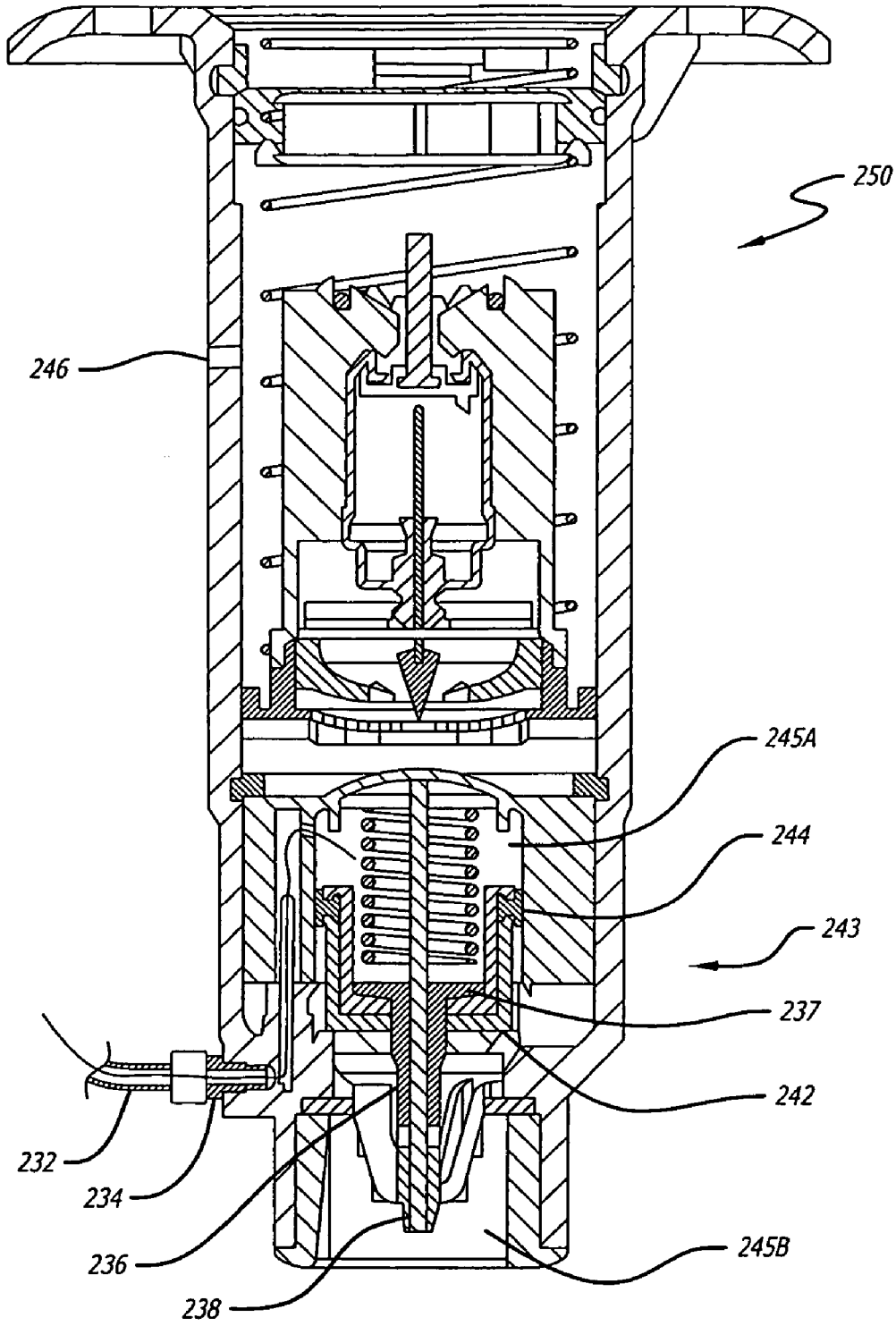
FIGS. 19–21 illustrate the adjustable pilot valve in accordance with the present invention.
Figure 20:
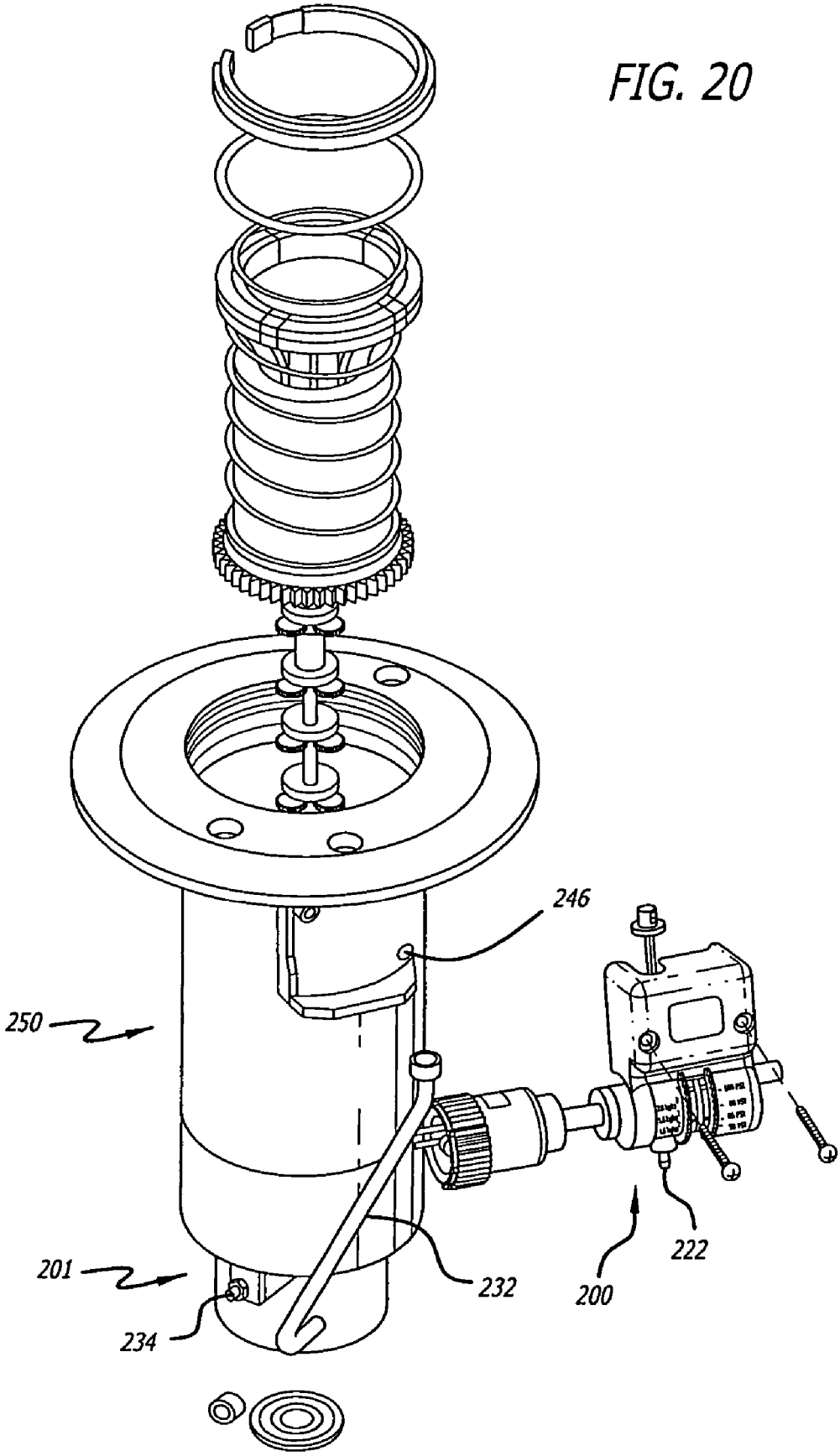
Figure 21:
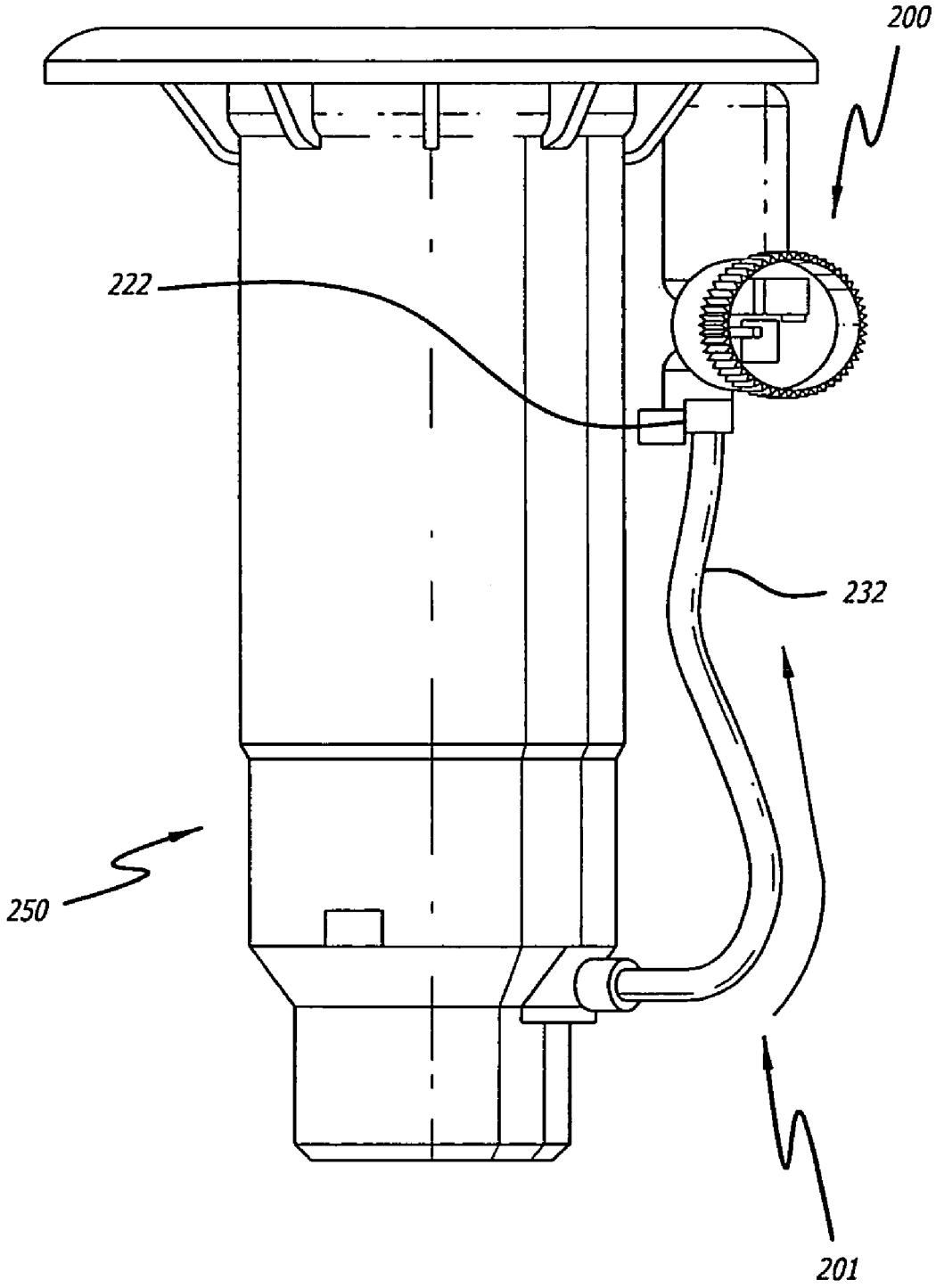

As seen in FIGS. 19–21, the pilot valve 201 is generally split into two discrete portions, the pressure regulating unit 200 located on the outer body of the sprinkler 250 (see FIG. 20 and 21), and the valve assembly 243 (see FIG. 19) positioned in the lower body of sprinkler 250.

As seen in FIGS. 20 and 21, the pressure regulating unit 200 mounts to the outer body of sprinkler 250 and is fluidly connected to the inside of the sprinkler 250 by pressure feedback port 246 via regulating port 224 and water discharge port 234 via discharge tube 232.

Figure 18C:
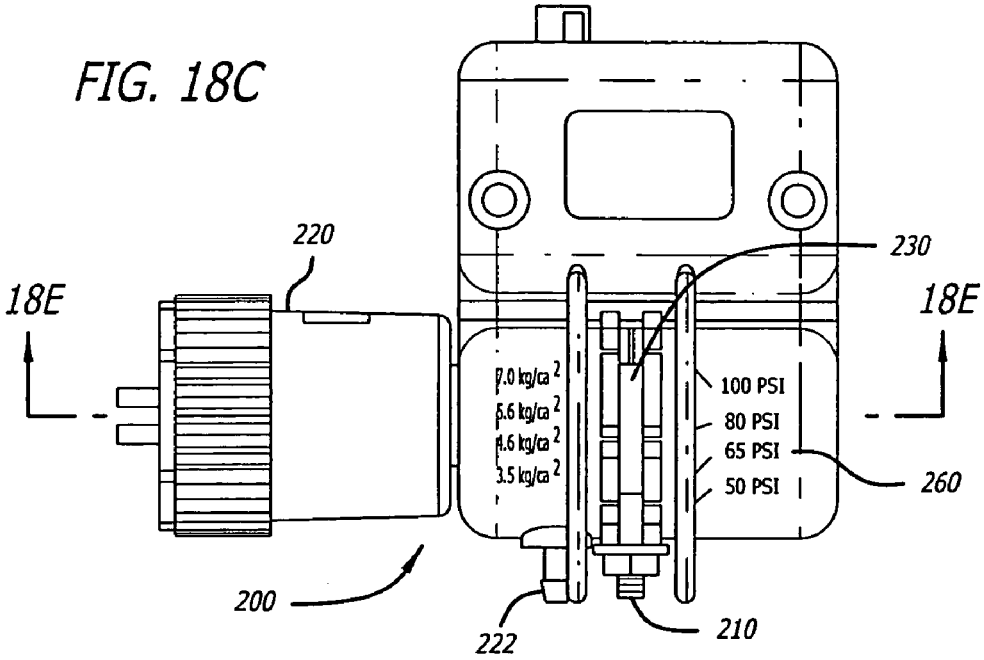
Figure 18D:
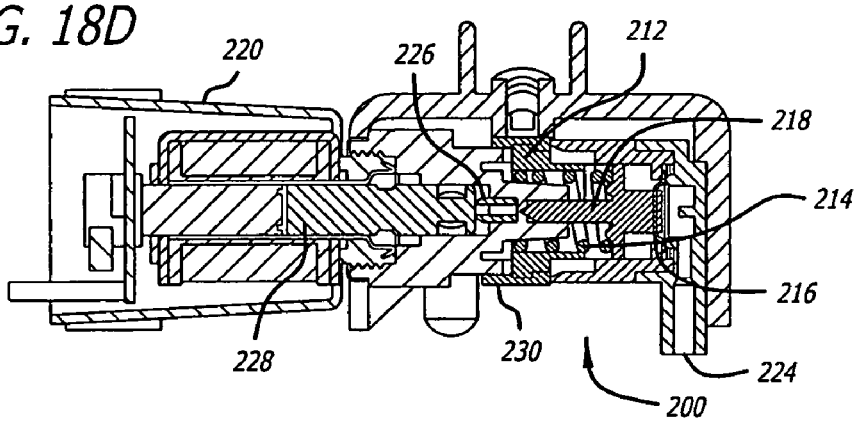
Figure 18E:
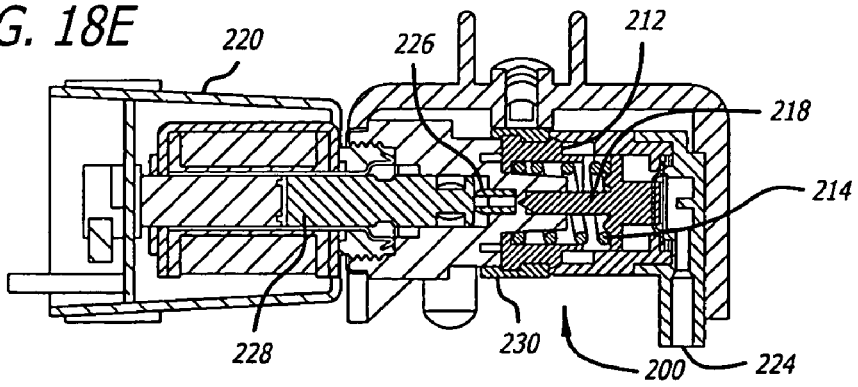

FIGS. 18D and 18E best show the internal structure of pressure regulating unit 200. As with most pilot valves, adjustable pilot valve 201 has an electrically controlled solenoid 220 which moves a plunger 228 against or away from discharge seat 226. The plunger 228 is shown pressed against the discharge seat 226 which closes the valve assembly 243, thus preventing water from flowing through the sprinkler. When the solenoid 220 is activated, it moves this plunger 228 away from the discharge seat 226, allowing water to flow into the regulating unit 200 through regulating unit port 222, through the discharge seat 226, past the needle valve 218 and finally to a regulating unit discharge port that vents to the outside atmosphere.

As described in further detail below, the valve assembly 243, seen best in FIG. 19, opens and closes based on pressure regulated by pressure regulating unit 200. Further, the water flow through the valve assembly 243 can be adjusted by controlling the pressure supplied to it, allowing it to only open a desired amount.

The pressure regulating unit 200 varies pressure by way of a feedback mechanism, best seen in FIGS. 17A, 17B, 18D, and 18E. The pressure feedback port 246 of the sprinkler 250 is connected to the regulating port 224 of the regulating unit 200. As water flow within the sprinkler 250 increases, water pushes through pressure feedback port 246 and regulating port 224, pushing against diaphragm 216. Diaphragm 216 is composed of an elastic material such as rubber or thermoplastic elastomer which allows it to stretch as water pressure increase.

As the diaphragm 216 stretches, it pushes on needle valve 218, partially closing the needle valve 218, in turn increasing pressure within the regulating unit 200, as seen in FIG. 18D and 18E. The needle valve 218 is normally kept open by spring 214, which presses in a direction opposite to the force of the diaphragm 216. Therefore, the pressure of the diaphragm 216 must overcome the force of the spring 214 in order to move needle valve 218.

Figure 17A:
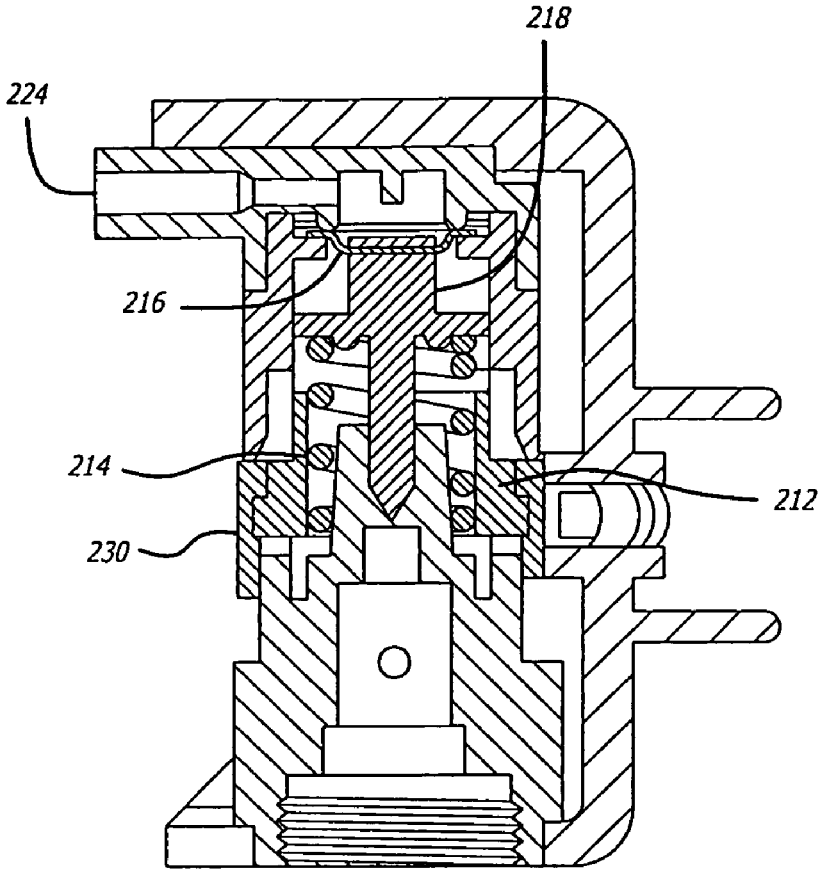
FIG. 17A illustrates an embodiment of an adjustable pilot valve in accordance with the present invention.
Figure 17B:
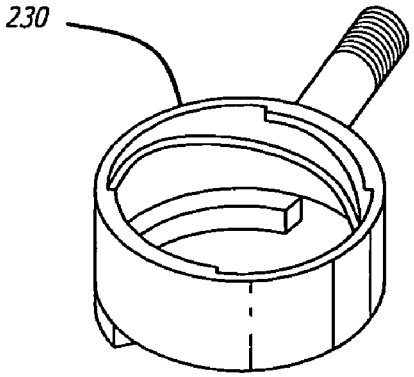
FIG. 17B illustrates an embodiment of a threaded adjuster in accordance with the present invention.

Referring to FIGS. 17A and 17B, the pressure exerted by the spring 214 against needle valve 218 can be adjusted by way of an internally threaded adjuster 230 and a traveling nut 212 positioned within with adjuster 230. The traveling nut 212 engages with the threading of the adjuster 230 to compress or decompress spring 214, thus varying the pressure on the needle valve 218. As previously mentioned, the adjuster 210 is shaped as a lever, but may also be shaped as a thumb wheel adjuster 218 as seen in FIG. 18A. The spring 214 and adjuster 230 may be calibrated and pressure indicia added to the outside of the regulating unit 200 so as to allow a user to adjust the water pressure within the sprinkler to a known rate.

As previously mentioned, the regulating unit 200 regulates the pressure within valve assembly 243 and thus controls whether the valve is open, closed, or somewhere in between. As seen in FIG. 19, the valve assembly 243 has an upper chamber 245*a* and lower chamber 245*b* separated by valve plunger 237 and further sealed by lip seal 244. However, the upper chamber 245*a* is sealed when the valve plunger 237 is seated against valve seat 242, except for the opening created by metering pin 238 and discharge port 234. Metering pin 238 passes through valve plunger 237, allowing a small flow of water to pass into the upper chamber. The arrow in FIG. 19 represents the flow of water from the upper chamber 145*a* out the discharge port 234.

When the water is turned on to the sprinkler 250, water passes through the gap in the metering pin 238 and travels into the upper chamber 245*a* of the valve assembly 243, creating pressure within the sprinkler body which keeps the valve 237 seated. When the pressure regulating unit 200 is activated to release pressure within the sprinkler body the pressure within the upper chamber 245*a* is released, thus allowing the valve plunger 237 to move upward and thereby allow the flow of water to move into the sprinkler 250, thus activating the sprinkler 250.

As best seen in FIG. 19, the open valve plunger 237 allows water to move around the upper chamber 245*a* and up the body of sprinkler 250. Thus, the water pressure within the body of sprinkler 250 dramatically increases, flowing out of the sprinkler nozzle (not shown) and pressure feedback port 246. The wider the valve 237 is open, the greater the water pressure in the body of sprinkler 250. As previously stated, pressure feedback port 246 is fluidly connected to the pressure regulating unit 200 by regulating port 224 (see FIG. 18*b*). As stated above, this pressure moves the needle valve 218, seen in FIG. 18E, partially closing the needle valve 218 and increasing pressure in the pressure regulating unit 200. Increased pressure in the pressure regulating unit 200 translates to increased pressure in the upper chamber 245*a*, which applies downward pressure on the valve 237, partially closing the valve 237. Thus, in this manner, the sprinkler 250 self regulates the water flow pushing through valve 237.

One particular benefit of this invention is that it eliminates the need for various springs 214 within the pressure regulating unit 200 to achieve different pressures. Springs have been traditionally used to add the above-described feedback adjustability features to an externally bled main valve. However, the present preferred embodiment allows for an adjustable spring 214 within pressure regulating unit 200, having visual pressure indicia 260 allowing for easy user adjustment. Thus a user can set a desired water pressure based on the pre-calculated pressure indicia 260.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. An adjustable arc sprinkler mechanism comprising:

an upper rotatable sprinkler housing;

a lower stationary sprinkler housing;

an arc stop assembly interposed between said upper and lower sprinkler housing;

said arc stop assembly including a fixed arc stop member and an angularly movable arc stop member;

a plurality of mating gear teeth disposed on said rotatable sprinkler housing and said arc stop assembly, said plurality of mating gear teeth being selectively engagable; and wherein at least one position of said angularly movable arc stop member enables said rotatable sprinkler housing to rotate in one continuous direction.

2. An adjustable arc sprinkler mechanism according to claim 1, wherein said angularly movable arc stop member is movable according to disengagement of said arc stop assembly from said upper rotatable-sprinkler housing.

3. An adjustable arc sprinkler mechanism according to claim 2, wherein said disengagement of said arc stop assembly is through vertical movement of said arc stop assembly.

4. An adjustable arc sprinkler mechanism according to claim 1, wherein said fixed arc stop member includes a radially flexible stop surface, said stop surface being radially flexed out of engagement with a trip arm when said upper rotatable sprinkler housing with said fixed arc stop member is moving in a full circle direction.

5. An adjustable arc sprinkler mechanism comprising:

a sprinkler housing having a rotating portion, a stationary portion and an arc adjustment mechanism;

said rotating portion including a first set of pear teeth;

said arc adjustment mechanism including a second set of gear teeth selectively engagable with said first set of gear teeth;

said arc adjustment mechanism including an arc stop selectively angularly movable relative to said rotating portion and said stationary portion so as to set a desired arc for said rotating portion of said sprinkler mechanism;

said arc stop being movable between a minimum arc setting and a full circle setting;

said arc stop being movable between said minimum arc setting and said full circle setting without changing a vertical height of said sprinkler mechanism.

6. An adjustable arc sprinkler mechanism according to claim 5, wherein said arc stop is movable according to disengagement of said arc adjustment mechanism from said rotatable portion.

7. An adjustable arc sprinkler mechanism according to claim 5, wherein said arc adjustment mechanism further includes a fixed arc stop member disposed on said rotating portion, wherein said fixed arc stop member includes a radially flexible stop surface, said stop surface being radially flexed out of engagement with a trip arm when said arc stop is at said full circle setting.

8. An adjustable arc sprinkler mechanism according to claim 5, wherein said arc stop is positioned outside the path of a direction trip mechanism when said arc stop is located at said full circle setting.

9. A method of establishing full circle operation of an adjustable arc sprinkler mechanism comprising:

providing a sprinkler having a rotating section, a stationary section and an arc adjustment section, wherein said sprinkler has an established sprinkler height;

disengaging said arc adjustment section from said rotating section without changing the overall height of said adjustable arc sprinkler mechanism by decoupling a geared engagement between said arc adjustment section and said rotating section;

moving said arc adjustment section to a full circle setting on said sprinkler;

maintaining said established sprinkler height during both the disengaging of said arc adjustment section and during the moving of said arc adjustment section to said full circle setting.

10. A method according to claim 9, wherein moving the arc adjustment section to a full circle selling includes moving an adjustable arc stop out of a path of a direction changing switch.

11. An adjustable arc sprinkler mechanism comprising:

an upper rotatable sprinkler housing;

a lower stationary sprinkler housing;

an arc stop assembly interposed between said upper and lower sprinkler housing;

said arc stop assembly including a fixed arc stop member and an angularly movable arc stop member; and, wherein at least one position of said angularly movable arc stop member enables said rotatable sprinkler housing to rotate in one continuous direction, and said angularly movable arc stop member is movable according to disengagement of said arc stop assembly from said upper rotatable sprinkler housing.

12. An adjustable arc sprinkler mechanism according to claim 11, wherein said disengagement of said arc stop assembly is through vertical movement of said arc stop assembly.

13. An adjustable arc sprinkler mechanism according to claim 11, wherein said fixed am stop member includes a radially flexible stop surface, said stop surface being radially flexed out of engagement with a trip arm when said upper rotatable sprinkler housing with said fixed arc stop member is moving in a full circle direction.

14. An adjustable arc sprinkler mechanism comprising:

an upper rotatable sprinkler housing;

a lower stationary sprinkler housing;

an arc stop assembly interposed between said upper and lower sprinkler housing;

said arc stop assembly including a fixed arc stop member disposed on said upper rotatable sprinkler housing and an angularly movable arc stop member, said fixed arc stop member including a radially flexible stop surface, said stop surface being radially flexed out of engagement with a sprinkler stop when said arc stop is at a full circle setting; and, wherein at least one position of said angularly movable arc stop member enables said rotatable sprinkler housing to rotate in one continuous direction.

15. An adjustable arc sprinkler mechanism according to claim 14, wherein said angularly movable arc stop member is movable according to disengagement of said arc stop assembly from said upper rotatable sprinkler housing.

16. An adjustable arc sprinkler mechanism according to claim 15, wherein said disengagement of said arc stop assembly is through vertical movement of said arc stop assembly.

17. An adjustable arc sprinkler mechanism comprising:

a sprinkler housing having a rotating portion, a stationary portion and an arc adjustment mechanism;

said arc adjustment mechanism including an arc stop selectively angularly movable relative to said rotating portion and said stationary portion so as to set a desired arc for said rotating portion of said sprinkler mechanism;

said arc stop being movable between a minimum arc setting and a full circle setting;

said arc stop being movable between said minimum arc setting and said full circle setting without changing a vertical height of said sprinkler mechanism; and wherein said arc stop is movable according to disengagement of an arc stop assembly from said rotatable portion.

18. An adjustable arc sprinkler mechanism according to claim 17, wherein said arc adjustment mechanism further includes a fixed arc stop member disposed on said rotating portion, wherein said fixed arc stop member includes a radially flexible stop surface, said stop surface being radially flexed out of engagement with a sprinkler stop when said arc stop is at said full circle setting.

19. An adjustable arc sprinkler mechanism according to claim 17, wherein said arc stop is positioned outside the path of a direction trip mechanism when said arc stop is located at said full circle setting.

20. An adjustable arc sprinkler mechanism comprising:

a sprinkler housing having a rotating portion, a stationary portion and an arc adjustment mechanism;

said arc adjustment mechanism including an arc stop selectively angularly movable relative to said rotating portion and said stationary portion so as to set a desired arc for said rotating portion of said sprinkler mechanism;

said arc stop being movable between a minimum arc setting and a full circle setting;

said arc stop being movable between said minimum arc setting and said full circle selling without changing a vertical height of said sprinkler mechanism;

said arc adjustment mechanism further including a fixed arc stop member disposed on said rotating portion, wherein said fixed arc stop member includes a radially flexible stop surface, said stop surface being radially flexed out of engagement with a sprinkler stop when said arc stop is at said full circle setting.

21. An adjustable arc sprinkler mechanism according to claim 20, wherein said arc stop is movable according to disengagement of said arc adjustment mechanism from said rotatable portion.

22. An adjustable arc sprinkler mechanism according to claim 20, wherein said arc stop is positioned outside the path of a direction trip mechanism when said arc stop is located at said full circle setting.

23. A method of establishing full circle operation of an adjustable arc sprinkler mechanism comprising:

providing a sprinkler having a rotating section, a stationary section and an arc adjustment section, wherein said sprinkler has an established sprinkler height and wherein said arc adjustment section includes an arc stop;

disengaging said arc adjustment section from said rotating section without changing the overall height of said adjustable arc sprinkler mechanism;

moving said arc stop of said adjustment section to a full circle setting on said sprinkler; and maintaining said established sprinkler height during both the disengaging of said arc adjustment section and during the moving of said arc stop of said adjustment section to said full circle setting.

24. A method according to claim 23, wherein moving said arc adjustment section to a full circle setting includes moving said arc stop out of a path of a direction changing switch.

25. A method according to claim 23 wherein said sprinkler further includes a plurality of mating gears disposed on said arc adjustment section and said rotating section.

26. A method according to claim 23 wherein said arc adjustment section further includes a fixed arc stop.

27. A method according to claim 26 wherein said fixed arc stop includes a radially flexible stop surface, said stop surface being radially flexed out of engagement with said direction changing switch.

28. A method of establishing full circle operation of an adjustable arc sprinkler mechanism comprising:

providing a sprinkler having a rotating section, a stationary section and an arc adjustment section, wherein said sprinkler has an established sprinkler height and wherein said arc adjustment section further includes a fixed arc stop member disposed on said arc adjustment section, wherein said fixed arc stop member includes a radially flexible stop surface;

disengaging said arc adjustment section from said stationary section without changing the overall height of said adjustable arc sprinkler mechanism;

moving said arc adjustment section to a full circle selling on said sprinkler;

maintaining said established sprinkler height during both the disengaging of said arc adjustment section and during the moving of said arc adjustment section to said full circle setting; and urging said radially flexible stop surface out of engagement with a trip arm when said arc adjustment section is at said full circle setting.

29. A method according to claim 28, wherein moving the arc adjustment section to said full circle setting includes moving an adjustable arc stop out of a path of said trip arm.

30. A method according to claim 28 wherein said sprinkler further includes a plurality of mating gear teeth on said rotating section and said arc adjustment section, said plurality of mating gear teeth being selectively disengagable.

31. A method according to claim 28 wherein said disengaging said arc adjustment section is performed by vertically urging said arc adjustment section away from said rotating section.

32. A method according to claim 28 wherein moving said arc adjustment section to said full circle selling includes rotating said adjustable arc section until an adjustable arc stop is positioned out of a path of said trip arm.

* * * * *

UNITED STATES PATENT AND TRADEMARK OFFICE

CERTIFICATE OF CORRECTION

PATENT NO. : 7,017,831 B2
APPLICATION NO. : 10/774831
DATED : March 28, 2006
INVENTOR(S) : Miguel Santiago et al.

It is certified that error appears in the above-identified patent and that said Letters Patent is hereby corrected as shown below:

-- (75) Inventors: Miguel Santiago, Claremont, CA (US); Jeff McKenzie, Blue Jay, CA (US);
Steven C. Renquist, Chino Hills, CA (US)--

Signed and Sealed this

Fifteenth Day of August, 2006

JON W. DUDAS
*Director of the United States Patent and Trademark Office*

UNITED STATES PATENT AND TRADEMARK OFFICE

CERTIFICATE OF CORRECTION

PATENT NO. : 7,017,831 B2
APPLICATION NO. : 10/774705
DATED : March 28, 2006
INVENTOR(S) : Miguel Santiago et al.

It is certified that error appears in the above-identified patent and that said Letters Patent is hereby corrected as shown below:

-- (75) Inventors: Miguel Santiago, Claremont, CA (US); Jeff McKenzie, Blue Jay, CA (US);
Steven C. Renquist, Chino Hills, CA (US)--

This certificate supersedes Certificate of Correction issued August 15, 2006.

Signed and Sealed this

Tenth Day of October, 2006

JON W. DUDAS
*Director of the United States Patent and Trademark Office*